US006931223B2

(12) United States Patent
Yamada

(10) Patent No.: US 6,931,223 B2
(45) Date of Patent: Aug. 16, 2005

(54) ELECTROPHOTOGRAPHIC IMAGE FORMING APPARATUS HAVING A HUMIDITY CONTROL FUNCTION

(75) Inventor: Masaaki Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 36 days.

(21) Appl. No.: 10/703,467

(22) Filed: Nov. 10, 2003

(65) Prior Publication Data

US 2004/0170444 A1 Sep. 2, 2004

(30) Foreign Application Priority Data

Nov. 11, 2002 (JP) ..... 2002-326293
Feb. 19, 2003 (JP) ..... 2003-041071

(51) Int. Cl.[7] ..... G03G 15/00
(52) U.S. Cl. ..... 399/97
(58) Field of Search ..... 399/92, 93, 97, 399/98, 168, 252, 297, 311, 313

(56) References Cited

U.S. PATENT DOCUMENTS

| | | | | | |
|---|---|---|---|---|---|
| 4,782,358 | A | * | 11/1988 | Shibayama et al. | 399/97 |
| 5,600,427 | A | * | 2/1997 | Watanabe et al. | 399/97 |
| 5,968,301 | A | | 10/1999 | Murakami et al. | |
| 6,654,573 | B2 | * | 11/2003 | Carlson et al. | 399/92 |
| 6,823,151 | B2 | * | 11/2004 | Carlson et al. | 399/92 |
| 2001/0010767 | A1 | * | 8/2001 | Watanabe | 399/92 |
| 2004/0175201 | A1 | * | 9/2004 | Maeda et al. | 399/92 |

FOREIGN PATENT DOCUMENTS

| | | | | | |
|---|---|---|---|---|---|
| JP | 5-72871 | | 3/1993 | | |
| JP | 6-83129 | | 3/1994 | | |
| JP | 8-16073 | | 1/1996 | | |
| JP | 8-302218 | | 11/1996 | | |
| JP | 9-81018 | | 3/1997 | | |
| JP | 2541556 | | 4/1997 | | |
| JP | 9-114321 | | 5/1997 | | |
| JP | 10-232591 | | 9/1998 | | |
| JP | 10-254330 | | 9/1998 | | |
| JP | 11-59933 | | 3/1999 | | |
| JP | 11-112709 | | 4/1999 | | |
| JP | 11149239 | A * | 6/1999 | ..... | G03G/21/20 |
| JP | 11202736 | A * | 7/1999 | ..... | G03G/21/20 |
| JP | 2002-72593 | | 3/2002 | | |
| JP | 2002-91105 | | 3/2002 | | |
| JP | 2003177654 | A * | 6/2003 | ..... | G03G/21/20 |

OTHER PUBLICATIONS

U.S. Appl. No. 10/703,467, filed Nov. 10, 2003, Yamada.
U.S. Appl. No. 10/942,899, filed Sep. 17, 2004, Satoh et al.

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus of the present invention includes a charging device having a charging mechanism positioned to face the circumference of a photoconductive drum and a casing member surrounding the charging means. A solid, high-molecular electrolytic film is mounted on the casing member with one surface facing the inside of the casing member and the other surface facing the outside of the same. A porous cathode is mounted on one surface of the electrolytic film, which faces the inside of the casing member, and connected to the cathode of a power supply. A porous anode is mounted on the other surface of the electrolytic film, which faces the outside of the casing member, and connected to the anode of the power supply.

44 Claims, 18 Drawing Sheets

ELECTROPHOTOGRAPHIC IMAGE FORMING APPARATUS HAVING A HUMIDITY CONTROL FUNCTION

BACKGROUND OF THE INVENTION

1. Field of the Invention

The present invention relates to a copier, printer, facsimile apparatus or similar electrophotographic image forming apparatus. More particularly, the present invention relates to an image forming apparatus capable of controlling inside humidity for thereby allowing each constituent device to stably operate in a particular, adequate humidity environment.

2. Description of the Background Art

Generally, an electrophotographic image forming apparatus includes a photoconductive drum or similar image carrier. A charging device, an image transferring device, a developing device and a cleaning device are arranged around the drum. Further, a fixing device, a sheet feeding device, a sheet discharging device and so forth are arranged in the apparatus. These devices are stably operable when humidity inside the apparatus lies in an adequate range, so that due consideration should be given to humidity in the apparatus. Usually, humidity around the drum should preferably be as low as possible while the other devices each have a particular, adequate humidity condition. A relation between each device and humidity will be described hereinafter.

The charging device, configured to uniformly charge the drum to positive or negative polarity, is implemented as, e.g., a charger or a charge roller. The problem with this kind of charging device is that ozone, nitrogen oxides and other gases are produced by discharge. If such discharge products stay around the charging device, then the discharge of the charging device becomes unstable with the result that charging and discharging are made irregular, lowering the quality of a toner image formed on the drum. Further, the discharge products deposited on the drum absorb moisture present in air to thereby lower the surface resistance of the drum, causing a latent image formed on the drum to flow and therefore blur. This is particularly conspicuous when relative humidity is as high as 80% RH or above.

The discharge products mentioned above have high resistance in a low humidity environment and deposit on, e.g., discharging means to thereby make discharge unstable and therefore make charge irregular. This is particularly conspicuous when relative humidity is as high as 30% RH or below.

As stated above, image quality is lowered when humidity around the charging device does not lie in an adequate range. This adequate range is one in which humidity is lower than a value that does not blur an image, but higher than a value that does not bring about irregular charging ascribable to unstable discharge.

As for the image transferring device, when surrounding humidity decreases below an adequate range, defective image transfer occurs due to abnormal discharge. When humidity increases above the adequate range, transferability of a toner image to a sheet or recording medium decreases, causing the toner to be easily scattered around or causing it to easily remain on the drum after image carrier. Thus, image quality is also lowered when humidity around the image transferring device does not lie in the adequate range. This adequate range is one in which humidity is higher than a value that brings about abnormal discharge, but lower than a value that degrades transferability.

In the developing device, when surrounding humidity is low, charge to deposit on the toner excessively increases and obstructs the deposition of the toner on the drum. When humidity is high, the above charge excessively decreases and causes the toner to deposit on the drum in an excessive amount in the event of development. In this manner, image quality is also lowered when humidity around the developing device does not lie in an adequate range, which allows the toner to deposit on the drum in an adequate amount.

When sheets stored in the sheet feeding device is subject to low humidity, it is likely that two or more sheets are fed together due to static electricity. When humidity is high, it is likely that no sheets are fed at all due to a decrease in the hardness of the sheets. Humidity should therefore be maintained in an adequate range in the sheet feeding device also. This adequate range is one that prevents two or more sheets from being fed together due to static electricity and obviates misfeed ascribable to the influence of humidity.

Further, the sheet, carrying the toner image thereon, is curled when driven out to the sheet discharging device due to heat and pressure applied to the sheet by the fixing device. To uncurl such a sheet, it is preferable to humidify the sheet stacked on the sheet discharging device.

In light of the above, Japanese Patent Laid-Open Publication Nos. 5-72871, 8-16073 and 9-81018, for example, propose various schemes for confining humidity inside an image forming apparatus in an adequate range. These conventional schemes, however, need a humidity control mechanism including a heater, a cooler, humidifying means and so forth that consume much power and need an exclusive space for the above mechanism, increasing the overall size of the apparatus. It is therefore impossible to apply the above schemes to a printer, facsimile apparatus or similar image forming apparatus that should be small size. Further, when the humidifying means that uses water is used, daily maintenance, including replenishment of water, sterilization of a water tank, removal of fur and so forth are required, increasing running cost and lowering reliability.

Technologies relating to the present invention are also disclosed in, e.g., Japanese Patent Laid-Open Publication Nos. 6-83129, 8-302218, 9-114321, 10-232591, 10-254330, 11-59933, 11-112709, 2002-72593 and 2002-91105 as well as in Japanese Utility Model No. 2,541,556.

SUMMARY OF THE INVENTION

It is an object of the present invention to provide an image forming apparatus capable of maintaining a particular, adequate humidity environment for each constituent device arranged therein.

It is another object of the present invention to provide an image forming apparatus capable of being reduced in size while executing humidity control.

It is still another object of the present invention to provide an image forming apparatus obviating the need for a tank for storing humidifying water or removed water while executing humidity control.

It is yet another object of the present invention to provide an image forming apparatus capable of maintaining preselected humidity over a substantial period of time even after a humidity control mechanism has stopped operating, thereby saving power.

It is a further object of the present invention to provide an image forming apparatus capable of reducing ozone, nitrogen oxides and other discharge products when humidifying a charging device or an image transferring device.

An image forming apparatus of the present invention includes a charging device including charging means positioned to face the circumference of a photoconductive drum and a casing member surrounding the charging means. A solid, high-molecular electrolytic film is mounted on the casing member with one surface facing the inside of the casing member and the other surface facing the outside of the same. A porous cathode is mounted on one surface of the electrolytic film, which faces the inside of the casing member, and connected to the cathode of a power supply. A porous anode is mounted on the other surface of the electrolytic film, which faces the outside of the casing member, and connected to the anode of the power supply.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the electrophotographic image forming apparatus in accordance with the present invention will be described hereinafter.

First Embodiment

Figure 1:
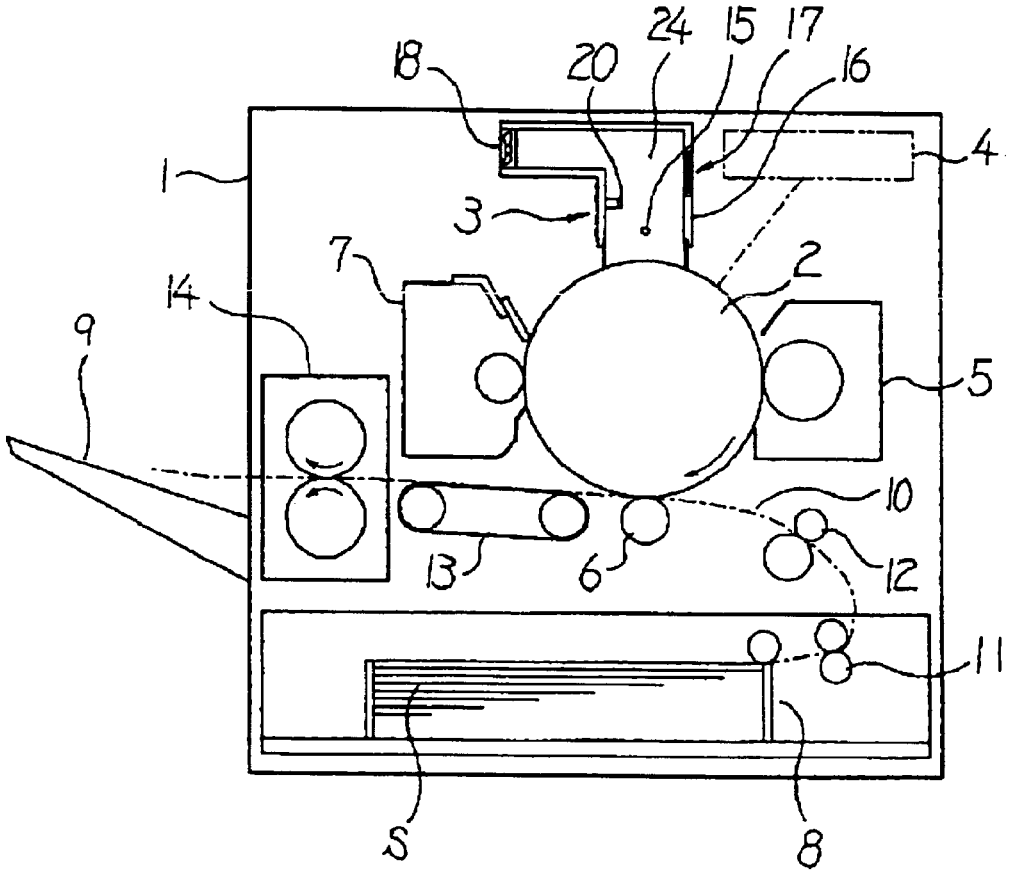
FIG. 1 is a view showing a first embodiment of the image forming apparatus in accordance with the present invention.
Figure 2:
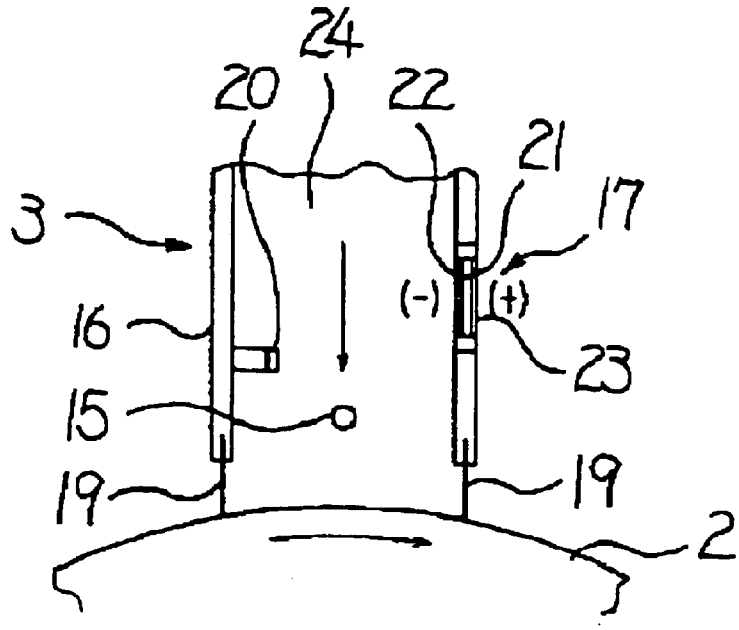
FIG. 2 is a front view showing a charger included in the first embodiment.

Referring to FIGS. 1 and 2, an image forming apparatus embodying the present invention is shown and implemented as a printer by way of example. As shown, the image forming apparatus includes a casing 1 and a photoconductive drum 2, which is a specific form of a photoconductive element or image carrier, positioned at substantially the center of the casing 1. Arranged around the drum 2 are a charging device 3, an optical writing unit 4, a developing device 5, an image transfer roller 6, and a cleaning device 7. After the charging device 3 has uniformly charged the surface of the drum 2, the optical writing unit 4 scans the surface of the drum 2 with a light beam in accordance with image data to thereby form a latent image. Subsequently, the developing device 5 deposits toner on the latent image for thereby producing a corresponding toner image. The toner image thus formed on the drum 2 is transferred to a sheet or recording medium S by the image transfer roller 6. The cleaning device 7 removes toner left on the drum 2 after the transfer of the toner image.

A sheet feeding device 8 is located below the drum 2, developing device 5 and so forth and loaded with a stack of sheets S. A sheet path 10 extends from the sheet feeding device 8 to a print tray 9. Arranged on the sheet path 10 are a roller pair 11, a registration roller pair 12, the image transfer roller 6, a belt conveyor 13, and a fixing device 14.

The charging device 3 includes a charge wire or charging means 15 positioned in parallel to the circumferential surface of the drum 2, a casing member 16 surrounding the charge wire 15, and a humidifying mechanism 17 configured to humidify a space around the charge wire 15. A fan 18 is connected to the casing member 16 in order to send air into the casing member 16. Flexible Mylar sheets 19 are fitted on the ends of the casing member 16 facing the drum 2 and held in contact with the drum 2. A humidity sensor 20 is mounted on the inner surface of the casing member 16 in order to sense humidity around the charge wire 15.

When the fan 18 is driven to send air into the casing member 16, ozone, nitrogen oxides and other discharge products are removed. Air thus sent into the casing member 16 flows out via the edges of the Mylar sheets 19 and the surface of the drum 2 contacting each other.

As shown in FIG. 2, the humidifying mechanism 17 includes a solid, high-molecular electrolytic film 21 mounted on the casing member 16 with one surface facing the inside of the casing member 16 and the other surface facing the outside of the same. A porous cathode 22 is mounted on the surface of the electrolytic film 21 facing inward and is connected to the cathode of a power supply, not shown. A porous anode 23 is mounted on the surface of the electrolytic film 21 facing outward and is connected to the anode of the power supply. When a DC current is caused to flow between the cathode 22 and the anode 23 sandwiching the electrolytic film 21, water molecules ($H_2O$) are decomposed into hydrogen ions ($H^+$), oxygen ($O_2$) and electrons ($e^-$)in a region facing the cathode 23. Hydrogen ions thus separated migrate toward the cathode 22 via the electrolytic film 21 and are then coupled with oxygen in a region facing the cathode 22 to become water.

The humidifying mechanism 17 is positioned upstream of the charge wire 15 in a direction in which air sent by the fan 18 flows. A humidifying air passage 24 is formed in the casing member 16 and configured to guide air sent to the region facing the cathode 22 toward the charge wire 15.

In operation, when humidity inside the casing member 16 drops below a preselected value, as determined by the humidity sensor 20, a controller, not shown, causes a DC current to flow between the cathode 22 and the anode 23 in response to the output of the sensor 20. As a result, water molecules are decomposed into hydrogen ions, oxygen and electrons in the region facing the anode 23. Hydrogen ions are then passed through the electrolytic film 21 and coupled with oxygen to become water in the casing member 16. Consequently, the space around the charge wire 16 is humidified. This successfully obviates abnormal discharge from the charge wire 15 ascribable to the drop of humidity around the charge wire 15, thereby obviating the defective charging of the drum 2 ascribable to abnormal discharge and the degradation of image quality ascribable to the defective charging. Air, thus humidified in the region facing the cathode 22, flows through the humidifying air passage 24 toward the charge wire 15 in a desirable manner.

Further, because oxygen is coupled with hydrogen ions in the casing member 16, the amount of oxygen decreases. Consequently, there can be reduced nitrogen oxides and ozone ascribable to discharge and therefore the degradation of image quality ascribable to nitrogen oxides and ozone.

Moreover, the humidifying mechanism 17, made up of the electrolytic film 21, porous cathode 22 and porous anode 23, is mounted on part of the casing member 16 and therefore does not need an exclusive space. It is therefore possible to reduce the size of the charging device 3 and that of the entire printer despite the addition of the humidifying mechanism 17.

As soon as humidity inside the casing 16 rises to the preselected value, as determined by the humidity sensor 20, the controller interrupts the feed of the DC current for thereby interrupting the operation of the humidifying mechanism 17.

Second Embodiment

Figure 3:
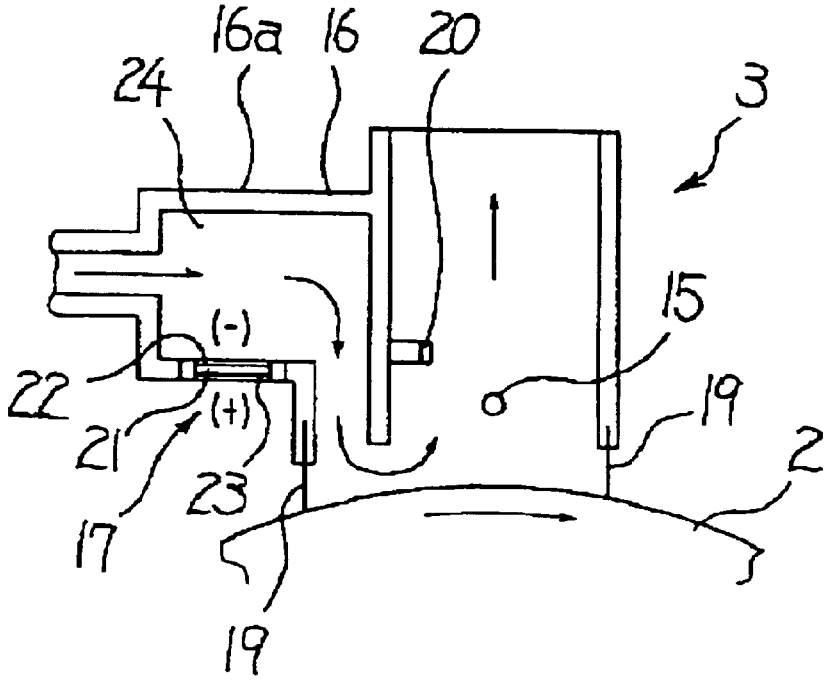
FIGS. 3 through 9 are views showing chargers respectively representative of a second to an eighth embodiment of the present invention.

FIG. 3 shows a second embodiment of the present invention. In the second embodiment as well as in the other embodiments to follow, structural parts and elements identical with those of the first embodiment are designated by identical reference numerals and will not be described specifically in order to avoid redundancy.

As shown, in the second embodiment, the humidifying mechanism 17 is mounted on a portion 16*a* of the casing member 16 protruding from the casing member 16. The portion 16*a* is positioned to face the circumference of the drum 2 such that the porous anode 23 faces the circumference of the drum 2. In this configuration, air, sent by the fan 18, FIG. 1, flows into the portion 16*a* of the casing member 16, then flows to the space around the charge wire 15, and then flows outward via the inside of the casing member 16 away from the drum 2.

When humidity inside the casing member 16 drops below the preselected value, as determined by the humidity sensor 20, the controller causes a DC current to flow between the cathode 22 and the anode 23 in response to the output of the sensor 20. As a result, the space inside the protruding portion 16*a* and facing the cathode 22 is humidified, so that humidified air flows to the space around the charge wire 15 via the humidifying air passage 24. Consequently, the space around the charge wire 16 is humidified as in the first embodiment. This successfully obviates abnormal discharge from the charge wire 15 ascribable to the drop of humidity around the charge wire 15, thereby obviating the defective charging of the drum 2 ascribable to abnormal discharge and the degradation of image quality ascribable thereto.

Further, in the region where the porous cathode 23 faces the circumference of the drum 2, water is decomposed, i.e., dehumidification occurs. As a result, the circumference of the drum 2 is dehumidified and can therefore be easily charged. Also, toner easily deposits on the drum 2 without the charge potential of the drum 2 being raised. This enhances image quality and protects the drum 2 from deterioration.

Third Embodiment

Figure 4:
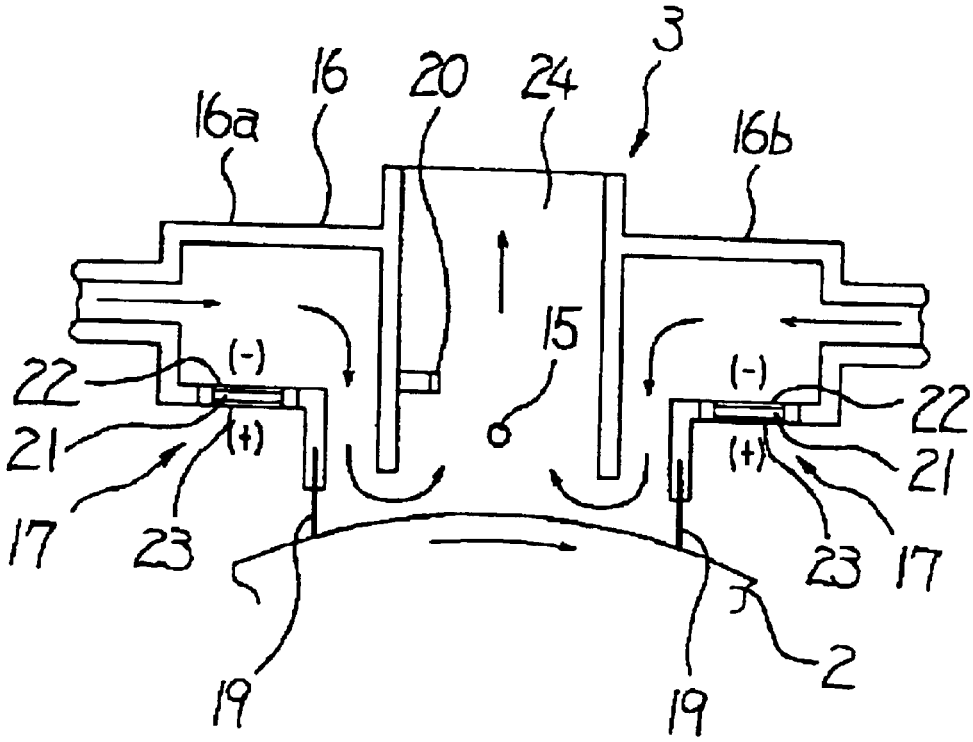

FIG. 4 shows a third embodiment of the present invention. As shown, the casing member 16 includes two protruding portions 16*a* and 16*b* each being provided with a respective humidifying mechanism 17. The protruding portions 16*a* and 16*b* are positioned to face the circumference of the drum 2 upstream and downstream, respectively, of the charge wire 15 in the direction of rotation of the drum 2. The porous anodes 23 of the humidifying mechanisms 17 face the circumference of the drum 2.

Air, sent by the fan 18, FIG. 1, flows through the two protruding portions 16*a* and 16*b* toward the space around the charge wire 15 and then flows outward via the inside of the casing member 16 away from the drum 2.

In the above configuration, spaces inside the protruding portions 16*a* and 16*b* and facing the cathodes 22 are humidified, so that humidified air flows to the space around the charge wire 15 to thereby humidify the space. This successfully obviates abnormal discharge from the charge wire 15 ascribable to the drop of humidity around the charge wire 15, thereby obviating the defective charging of the drum 2 ascribable to abnormal discharge and the degradation of image quality ascribable thereto.

Further, in the region where the porous cathodes 23 face the circumference of the drum 2, water is decomposed, i.e., dehumidification occurs. As a result, the circumference of the drum 2 is dehumidified and can therefore be easily charged. Also, toner easily deposits on the drum 2 without the charge potential of the drum 2 being raised. This enhances image quality and protects the drum 2 from deterioration. This advantage is further enhanced because the circumference of the drum 2 is dehumidified at both of the positions upstream and downstream of the charge wire 15 in the direction of rotation of the drum 2.

Fourth Embodiment

Figure 5:
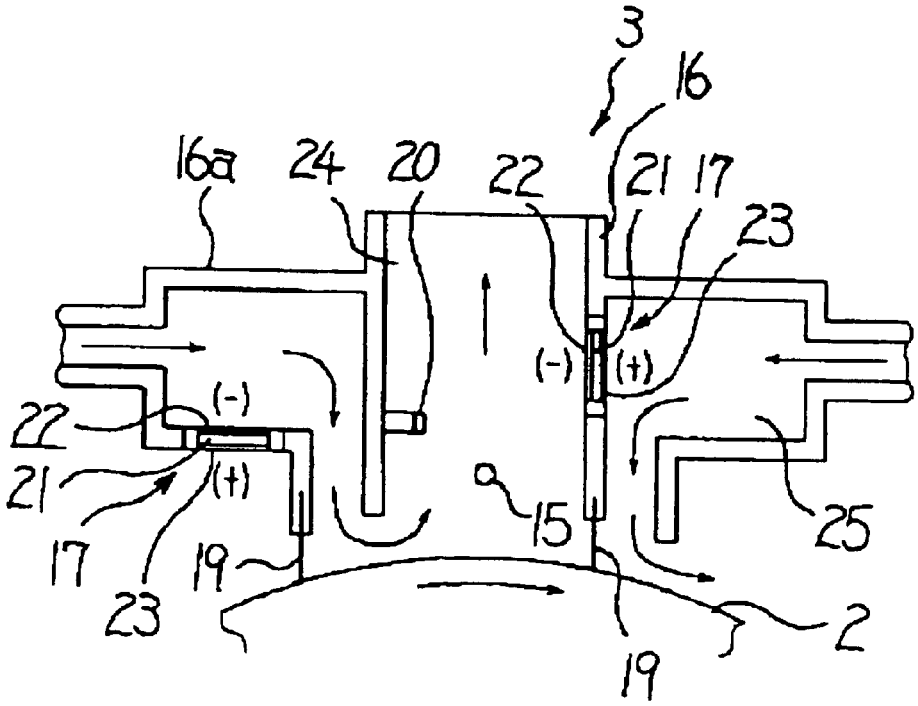

FIG. 5 shows a fourth embodiment of the present invention. As shown, a dehumidifying air passage 25 is formed outside of the casing member 16 and configured to guide air from the region facing the porous anode 23 toward the circumference of the drum 2. To send air via the dehumidifying air passage 25, use may be made of the fan 18, FIG. 1, or an air stream produced by the rotation of the drum 2 and sucking air toward the circumference of the drum 2.

In the above configuration, air in the region facing the anode 23 is dehumidified because water in this part of air is decomposed. Such dehumidified air flows toward the circumference of the drum 2 via the dehumidifying air passage 25, dehumidifying the region facing the circumference of the drum 2. The drum 2 can therefore be easily charged. Also, toner easily deposits on the drum 2 without the charge potential of the drum 2 being raised. This enhances image quality and protects the drum 2 from deterioration.

Fifth Embodiment

Figure 6:
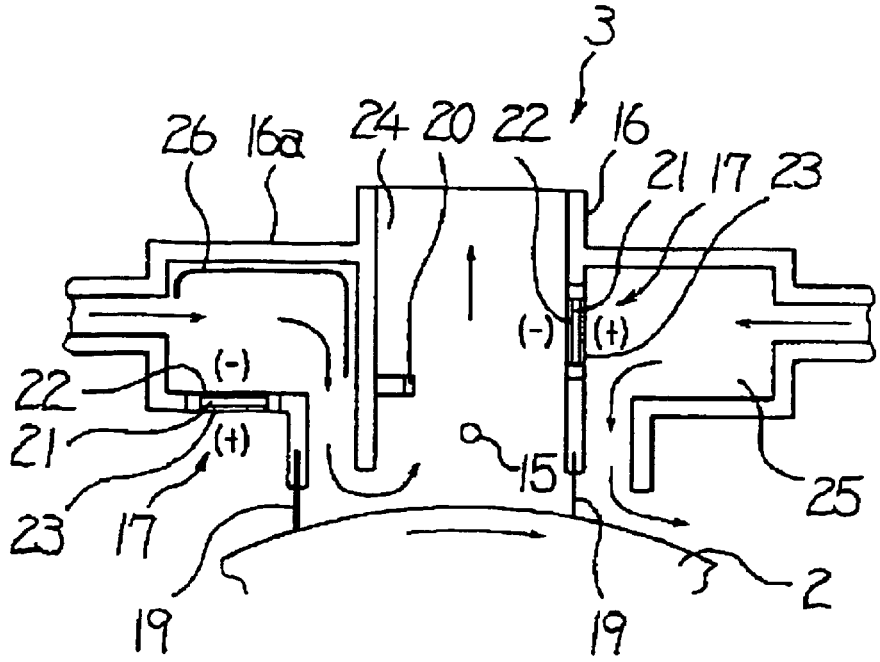

FIG. 6 shows a fifth embodiment of the present invention substantially identical with the fourth embodiment except for the following. As shown, a body 26 in which fine grains of water-absorptive resin is uniformly dispersed is positioned in the protruding portion 16*a* of the casing member 16. The body 26 absorbs moisture when surrounding humidity is above a preselected value or releases it when surrounding humidity is below the preselected value, thereby maintaining surrounding humidity at the preselected value.

In the above configuration, even when humidity outside of the casing member 16 becomes low, moisture released from the body 26 prevents humidity around the charge wire 15, which is positioned in the casing member 16, from immediately dropping. The illustrative embodiment therefore reduces the duration of the DC current to be applied between the first and the second porous electrodes 22 and 23 and thereby saves power, compared to the case wherein the body 26 is absent.

Sixth Embodiment

Figure 7:
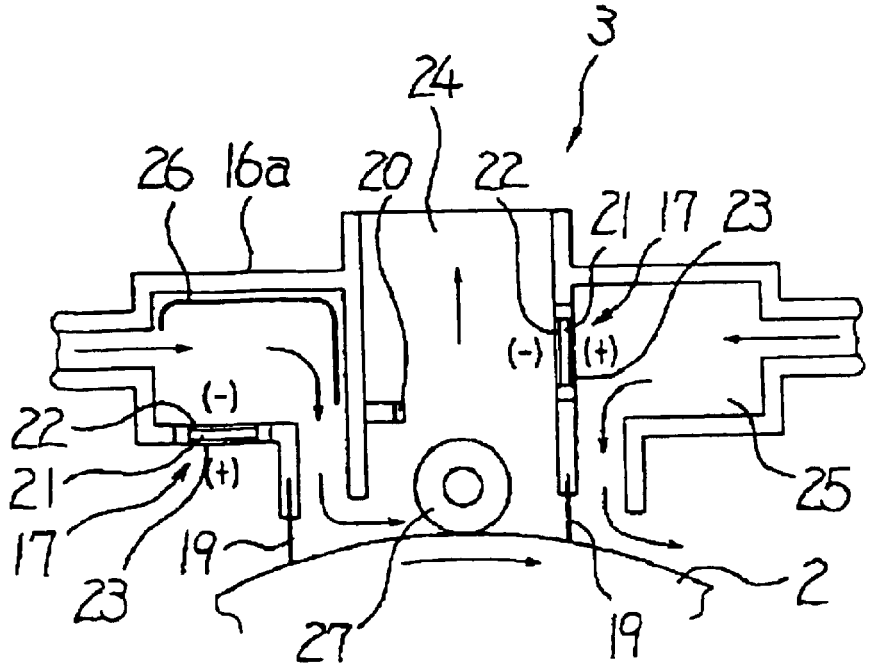

FIG. 7 shows a sixth embodiment of the present invention substantially identical with the fifth embodiment except for the following. As shown, the charge wire 15 is replaced with another charging means implemented as a contact type charge roller or contact type charging means 27. The charge roller 27 produces a minimum of discharge products, including ozone and nitrogen oxides, when charging the drum 2, but the charge potential deposited thereby is apt to vary in accordance with temperature and humidity.

In the illustrative embodiment, the humidifying mechanisms 17 prevent humidity around the charge roller 27 from excessively decreasing and therefore obviates an increase in charge start potential and a decrease in charge current. This is successful to prevent the charge potential of the drum 2 from dropping and bringing about fog and other image defects.

Seventh Embodiment

Figure 8:
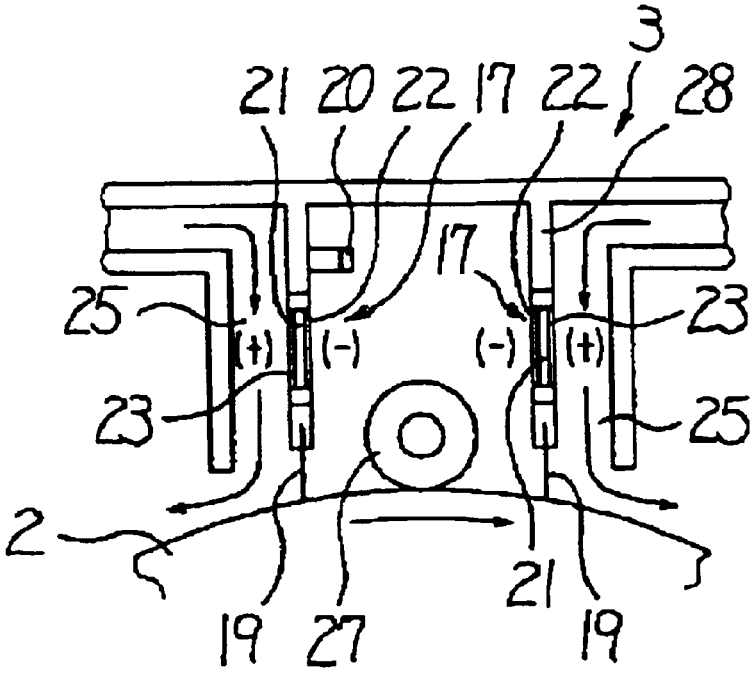

FIG. 8 shows a seventh embodiment of the present invention. As shown, air is not sent into part of a casing member 28 surrounding the charge roller 27, so that air-tightness of the casing member 28 is enhanced. The humidifying mechanisms 17 are mounted on part of the casing member 28 as in the previous embodiments. Dehumidifying air passages 25 are formed outside of the casing member 28 and configured to guide air from regions facing the porous anodes 23 toward the circumference of the drum 2.

In the above configuration, when a DC current is fed between each cathode 22 and the associated anode 23 in order to humidify the inside of the casing member 28, humidity inside the casing member 28 rises to the preselected value. When the current is interrupted later, humidity inside the casing member 28 does not immediately drop because of the enhanced air-tightness of the inside of the casing member 28 around the charge roller 27. Therefore, even when the humidity of the surrounding environment is low, the current for humidification does not have to be continuously fed, but should only be intermittently fed in order to save power.

Eighth Embodiment

Figure 9:
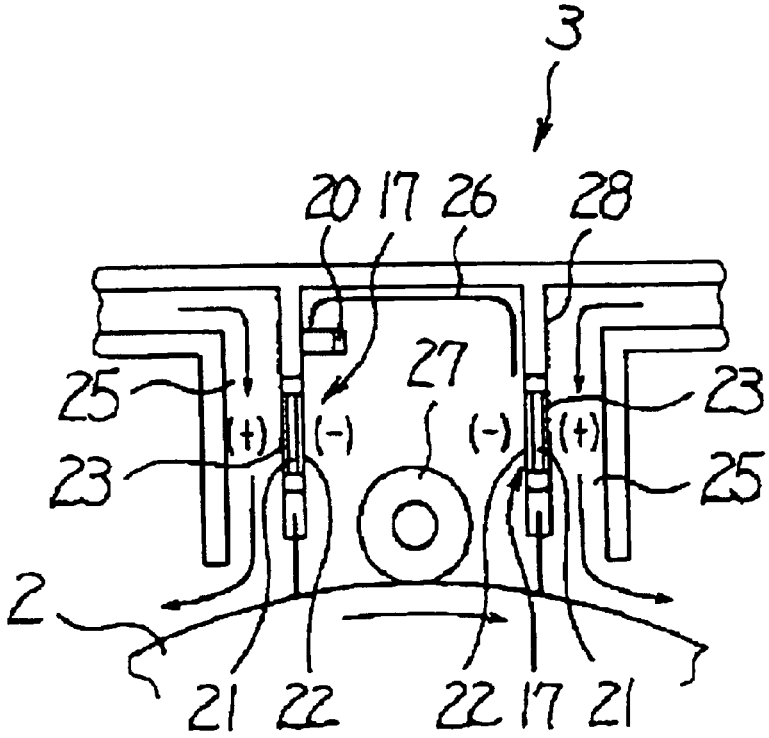

FIG. 9 shows a ninth embodiment of the present invention substantially identical with the seventh embodiment except for the following. As shown, the body 26 in which the water-absorptive resin is dispersed is positioned in the casing member 28. The body 26 absorbs moisture produced by humidification and can therefore release it when humidity is low, so that the period of intermittent current feed for humidification can be increased. This not only reduces the frequency of current feed, but also enhances durability of a switching circuit not shown.

Ninth Embodiment

Figure 10:
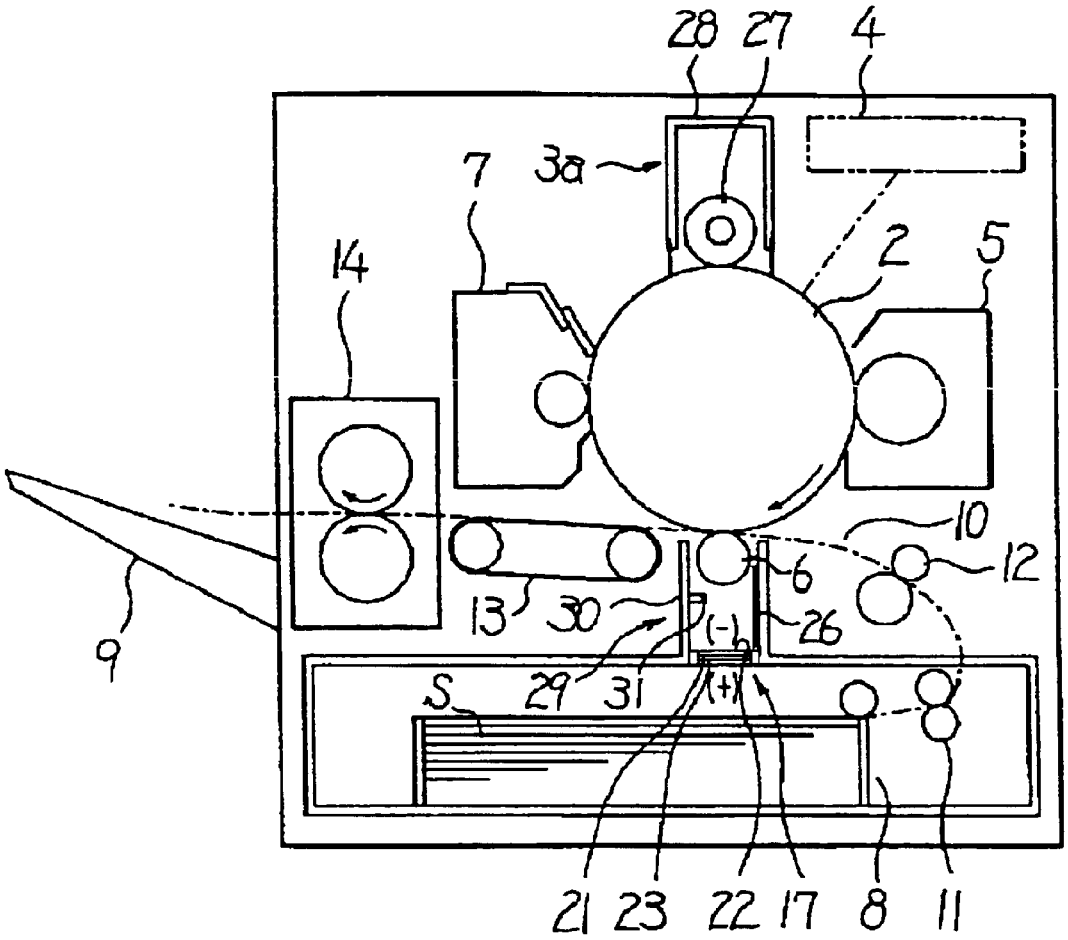
FIGS. 10 through 14 are views respectively showing a ninth to a thirteenth embodiment of the present invention.

Reference will be made to FIG. 10 for describing a ninth embodiment of the present invention. As shown, a charging device 3*a* and an image transferring device 29, as well as the optical writing unit 4, developing device 5 and cleaning device 7, are arranged around the drum 2. While the charging device 3*a* includes the charge roller 27 and casing member 28 surrounding it, it is not provided with the humidifying mechanism 17.

In the illustrative embodiment, the image transferring device 29 includes a casing member 30 surrounding the image transfer roller 6 as well as the humidifying mechanism 17. The dehumidifying mechanism 17 includes the solid, high-molecular electrolytic film 21 mounted on the casing member 30 with one surface facing the inside of the casing member 30 and the other surface facing the outside of the same. Again, the porous cathode 22 is mounted on the surface of the electrolytic film 21 facing the inside of the casing member 30 and is connected to the cathode of the power supply. The porous anode 23 is mounted on the surface of the electrolytic film 21 facing the outside of the casing member 30 and is connected to the anode of the power supply. The anode 23 faces the sheet feeding device 8 loaded with sheets S.

The body 26 in which water-absorptive resin is dispersed and a humidity sensor 31 are disposed in the casing member 30.

In operation, when humidity inside the casing member 30 drops below a preselected value, as determined by the humidity sensor 31, the controller causes a DC current to flow between the cathode 22 and the anode 23 in response to the output of the sensor 31. As a result, water molecules are decomposed into hydrogen ions, oxygen and electrons in the region facing the anode 23. Hydrogen ions are then passed through the electrolytic film 21 and coupled with oxygen to become water in the casing member 30. Consequently, the space around the image transfer roller 6 is humidified. This successfully obviates abnormal discharge from the image transfer roller 6 ascribable to the drop of humidity around the roller 6, thereby obviating the scattering of toner to occur at the time of image transfer from the drum 2 to the sheet S due to the abnormal discharge.

Further, the humidifying mechanism 17 included in the image transferring device 29 is mounted on part of the casing member 30 and therefore does not need an exclusive space. It is therefore possible to reduce the size of the image transferring device 29 and that of the entire printer despite the addition of the humidifying mechanism 17.

When the DC current is fed between the cathode 22 and the anode 23, water in the region facing the anode 23 is decomposed, i.e., dehumidification occurs. As a result, the region around the sheet feeding device 8 is dehumidified because the anode 3 faces the sheet feeding device 8, preventing two or more sheets S from being fed together due to moisture.

Moreover, even when humidity outside the casing member 16 becomes low, moisture released from the body 26 prevents humidity around the image transfer roller 6, which is positioned in the casing member 30, from immediately dropping. The illustrative embodiment therefore reduces the duration of the DC current to be applied between the cathode 22 and the anode 23 and thereby saves power.

Of course, the charging device 3*a* of the illustrative embodiment may be replaced with the charging device 3 of any one of the previous embodiments that includes the humidifying mechanism 17.

Tenth Embodiment

Figure 11:
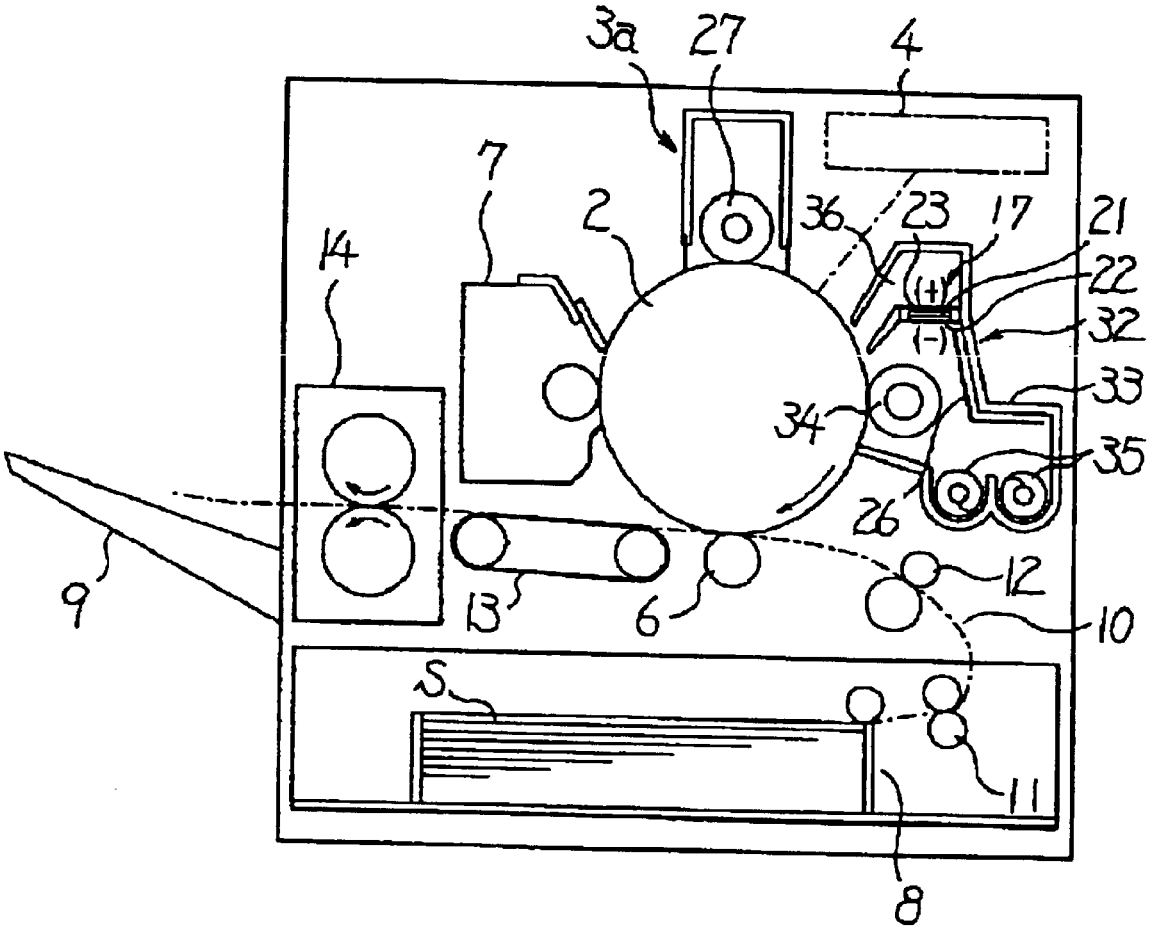

Referring to FIG. 11, a tenth embodiment of the present invention will be described. As shown, a developing device 32 is arranged around the drum 2 together with the charging device 3*a*, optical writing unit 4, image transfer roller 6 and cleaning device 7.

The developing device 32 includes a toner case 33 storing toner, a developing roller 34 disposed in the toner case 33, a screw 35 for conveying the toner while agitating it, and the humidifying mechanism 17. The humidifying mechanism 17 includes the electrolytic film 21 mounted on the toner case 33 with one surface facing the inside of the toner case 33 and the other surface facing the outside of the same. The porous cathode 22 is mounted on the surface of the electrolytic film 21 facing the inside of the toner case 33 and is connected to the cathode of the power supply. The porous anode 23 is mounted on the surface of the electrolytic film 21 facing the outside of the toner case 33 and is connected to the anode of the power supply.

A dehumidifying air passage 36 is formed outside of the toner case 33 in order to guide air from a region facing the anode 23 toward the circumference of the drum 2. To send air, use may be made of the fan 18, FIG. 1, or an air stream produced by the rotation of the drum 2 and sucking air toward the circumference of the drum 2. The body 26 and humidity sensor, not shown, are disposed in the toner case 33.

In operation, when humidity inside the toner case 33 drops below a preselected value, as determined by the humidity sensor, the controller causes a DC current to flow between the cathode 22 and the anode 23 in response to the output of the sensor. As a result, water molecules are decomposed into hydrogen ions, oxygen and electrons in the region facing the anode 23. Hydrogen ions are then passed through the electrolytic film 21 and coupled with oxygen to become water in the toner case 33. This successfully prevents the charge of the toner in the toner case 33 from excessively increasing due to drying and allows the toner to easily deposit on the drum 2. Therefore, high image quality is achievable without increasing the potential of the drum 2.

In the illustrative embodiment, humidification is achievable without sending humidified air into the toner case 33, so that the toner is prevented from flying about in the event of humidification; otherwise, the toner would leak to the outside of the toner case 33 or the feed of the toner to the developing roller 34 would be defective.

Further, the humidifying mechanism 17, made up of the electrolytic film 21, cathode 22 and anode 23, is mounted on part of the toner case 33 and therefore does not need an exclusive space. It is therefore possible to reduce the size of the developing device 32 and that of the entire printer despite the addition of the humidifying mechanism 17.

Further, in the region facing the anode 23, water present in air is decomposed, i.e., dehumidification occurs. As a result, the circumference of the drum 2 is dehumidified by air thus dehumidified and flowing via the passage 36 and can therefore be easily charged. Also, toner easily deposits on the drum 2 without the charge potential of the drum 2 being raised. This enhances image quality and protects the drum 2 from deterioration.

Further, the body 26, disposed in the toner case 33, absorbs moisture when humidity is high and then releases it when humidity is low. Therefore, even when humidity in the surrounding environment decreases, water, released from the body 26, prevents humidity inside the toner case 33 from immediately dropping. This reduces the duration of the DC current to be fed between the cathode 22 and the anode 23 for thereby saving power.

Of course, the charging device 3*a* of the illustrative embodiment may also be replaced with the charging device 3 of any one of the previous embodiments that includes the humidifying mechanism 17. Further, the image transfer roller 6 may be replaced with the image transferring device 29 of the ninth embodiment that includes the humidifying mechanism 17.

Eleventh Embodiment

Figure 12:
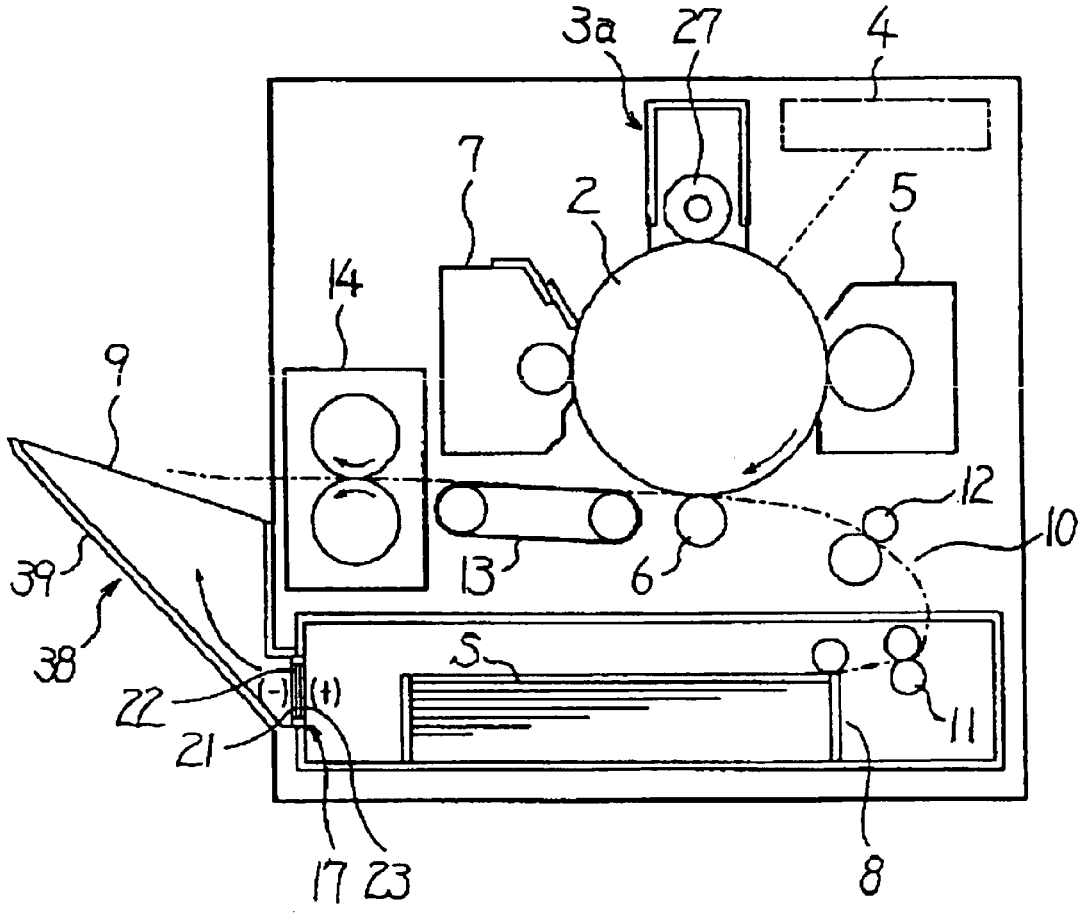

FIG. 12 shows an eleventh embodiment of the present invention. As shown, the charging device 3*a*, optical writing unit 4, developing device 5, image transfer roller 6 and cleaning device 7 are arranged around the drum 2. A sheet or recording medium discharging device 38 is mounted on one side of the casing 1 and allows consecutive sheets S sequentially conveyed via the sheet path 10 to be stacked thereon.

The sheet discharging device 38 includes the print tray 9, a casing member 39 surrounding the print tray 9 and the underside of the sheet S stacked on the print tray 9, and the humidifying mechanism 17. The humidifying mechanism 17 includes the solid, high-molecular electrolytic film 21 mounted on the casing member 39 with one surface facing the inside of the casing member 39 and the other surface facing the outside of the same. The porous cathode 22 is mounted on the surface of the electrolytic film 21 facing the inside of the casing member 39 and is connected to the cathode of the power supply. The porous anode 23 is mounted on the surface of the electrolytic film 21 facing the outside of the casing member 39 and is connected to the anode of the power supply. The anode 23 is positioned to face the sheet feeding device 8.

In operation, when a DC voltage is applied between the cathode 22 and the anode 23, the inside of the casing member 39 facing the cathode 22 is humidified. In this condition, the sheet S, driven out to the print tray 9 with a curl ascribable to the fixing device 14, is humidified and uncurled thereby. In addition, because the sheet discharging device 38 does not send humidified air toward the sheet S, consecutive sheets S can be neatly stacked despite humidification.

Further, the humidifying mechanism 17 is mounted on part of the casing member 39 and therefore does not need an exclusive space. This reduces the size of the sheet discharging device 39 and that of the entire printer despite the addition of the humidifying mechanism 17.

When the DC voltage is applied between the cathode 22 and the anode 23, water in the region facing the anode 23 is decomposed, i.e., dehumidification occurs. As a result, a region around the sheet feeding device 8 is dehumidified because the anode 23 faces the device 8, preventing two or more sheets from being fed together due to humidity.

Of course, the charging device 3*a*, developing device 5 and image transfer roller 6 each lacking the humidifying mechanism 17 may be replaced with any one of the charging devices 3, FIGS. 1 through 9, developing device, FIG. 11, and image transferring device, FIG. 10, each including the humidifying mechanism 17.

Twelfth Embodiment

Figure 13:
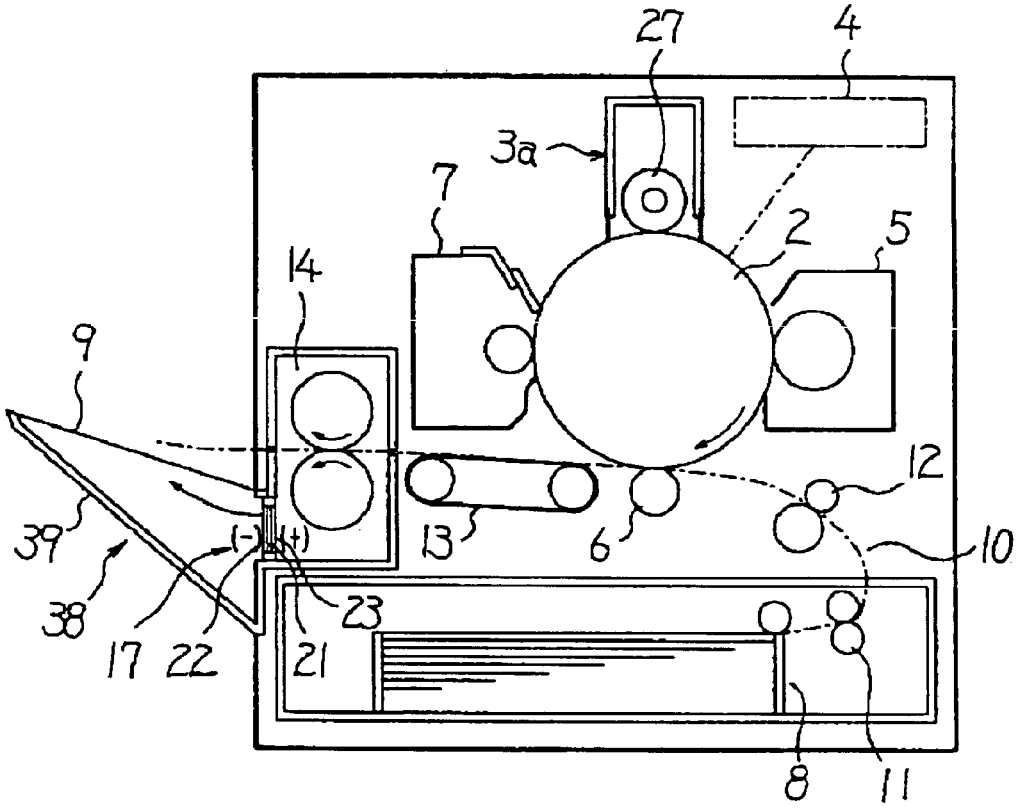

FIG. 13 shows a twelfth embodiment of the present invention substantially identical with the eleventh embodiment except for the following. As shown, the porous anode 23 of the humidifying mechanism 17 is positioned to face the fixing device 14. When a DC voltage is applied between the cathode 22 and the anode 23, water in the region facing the anode 23 is decomposed, i.e., dehumidification occurs. Therefore, the anode 23, facing the fixing device 14, dehumidifies a region around the fixing device 14. Consequently, vapor produced from the sheet S due to the heat of the fixing device 14 is removed, so that dew condensation in the printer ascribable to the above vapor is obviated.

Thirteenth Embodiment

A thirteenth embodiment of the present invention will be described with reference to FIGS. 14 through 17. Briefly, the illustrative embodiment includes a humidity control mechanism capable of selectively effecting humidification or dehumidification, as needed. Because the illustrative embodiment is identical in basic configuration with the first embodiment, FIG. 1, the following description will concentrate on arrangements unique to the illustrative embodiment.

Figure 14:
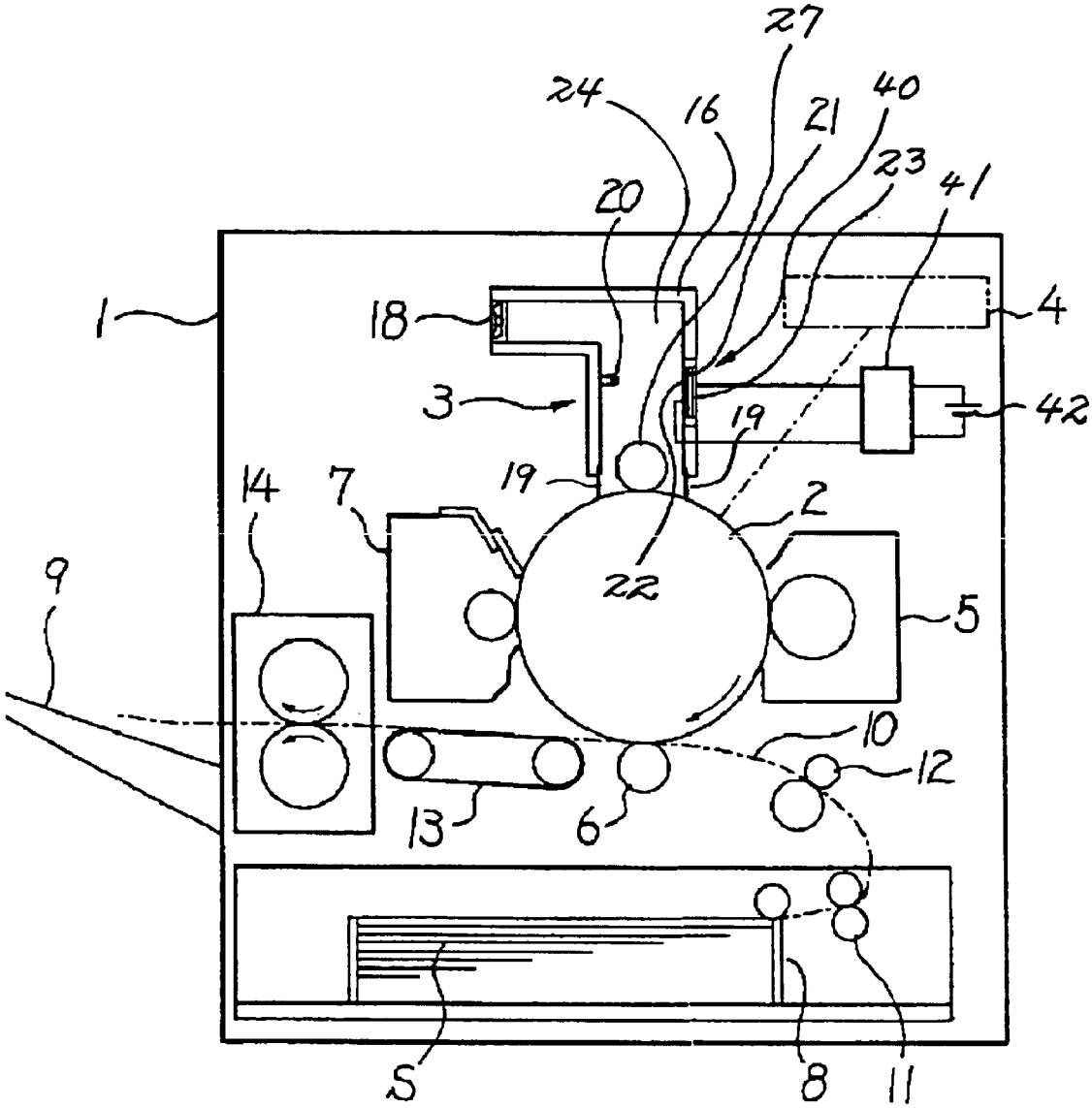
Figure 15:
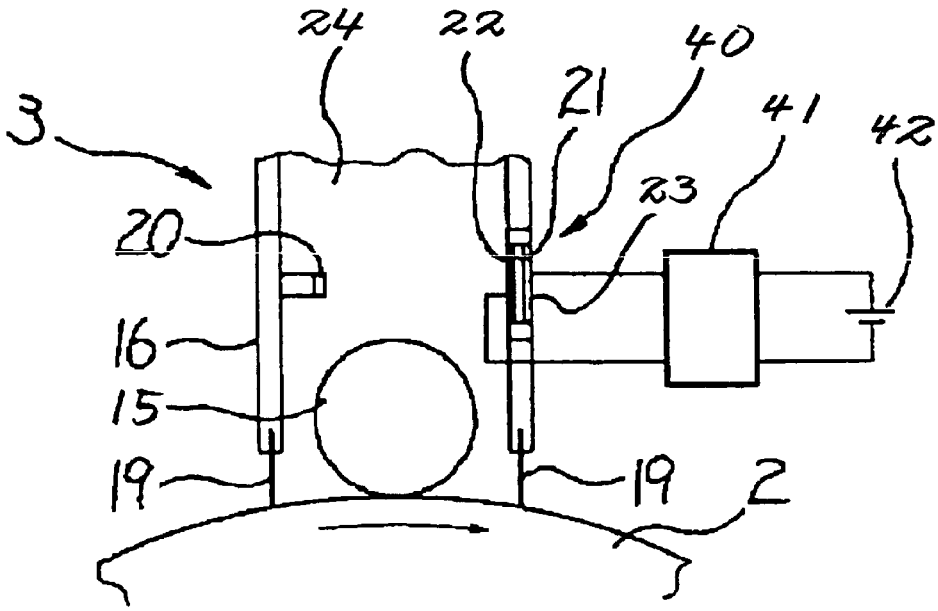
FIG. 15 is a view showing a charger included in the thirteenth embodiment.

As shown in FIGS. 14 and 15, the humidity control mechanism, labeled 40, includes the solid, high-molecular electrolytic film 21 mounted on the casing member 16 with one surface facing the inside of the casing member 16 and the other surface facing the outside of the same. A first porous electrode 22 is mounted on the surface of the electrolytic film 21 facing the inside of the casing member 16 and is connected to one electrode of a power supply 42 via a switch 41. A second porous electrode 23 is mounted on the surface of the electrolytic film 21 facing the outside of the casing member 16 and is connected to the other electrode of the power supply 42 via the switch 41.

In operation, when a DC voltage is applied between the first and the second electrodes 22 and 23 mounted on opposite surfaces of the electrolytic film 21, water molecules are decomposed into hydrogen ions, oxygen and electrons in the electrode region to which an anode voltage is applied. Hydrogen ions thus separated are passed through the electrolytic film 21 to the other electrode region to which a cathode voltage is applied, and then coupled with oxygen to become water. In this manner, dehumidification occurs at the electrode side to which the anode voltage is applied while humidification occurs at the other electrode side to which the cathode voltage is applied.

The humidity control mechanism 40 is positioned upstream of the contact type charge roller 27 in the direction in which air sent by the fan 18 flows. The air passage 24 is formed in the casing 16 for guiding air sent by the fan 18 to the region facing the first electrode 22 toward the charge roller 27.

Figure 16:
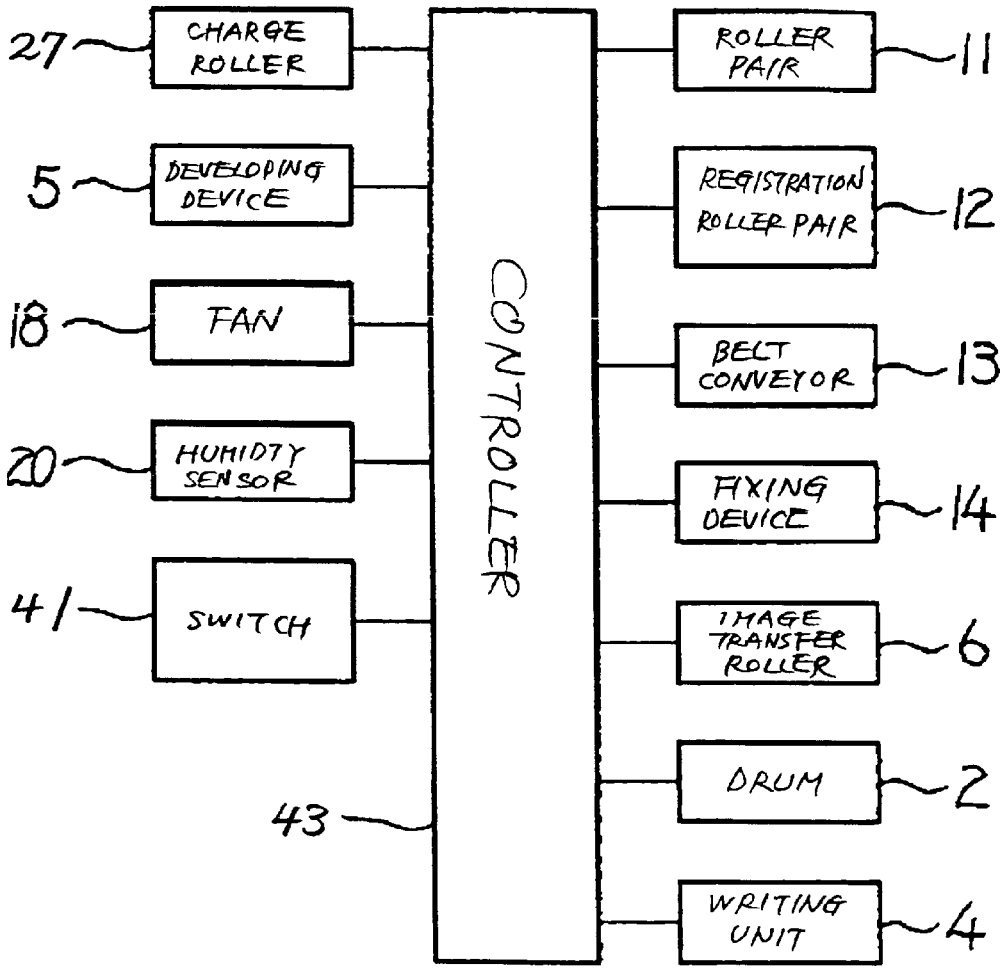
FIG. 16 is a block diagram schematically showing electric connection of various sections included in the thirteenth embodiment.

As shown in FIG. 16, the illustrative embodiment further includes a controller 43 implemented as a microcomputer that includes a CPU (Central Processing Unit), a ROM (Read Only Memory) and a RAM (Random Access Memory) although not shown specifically. Connected to the controller 43 are the drum 2, roller pair 11, registration roller pair 12, belt conveyor 13, fixing device 14, charge roller 27, optical writing unit 4, developing device 5, image transfer roller 6, humidity sensor 20, fan 18, and switch 41. The RAM stores a control program together with data to be used for operating the switch 41 in accordance with the output of the humidity sensor 20, i.e., humidity in the casing member 16.

Figure 17:
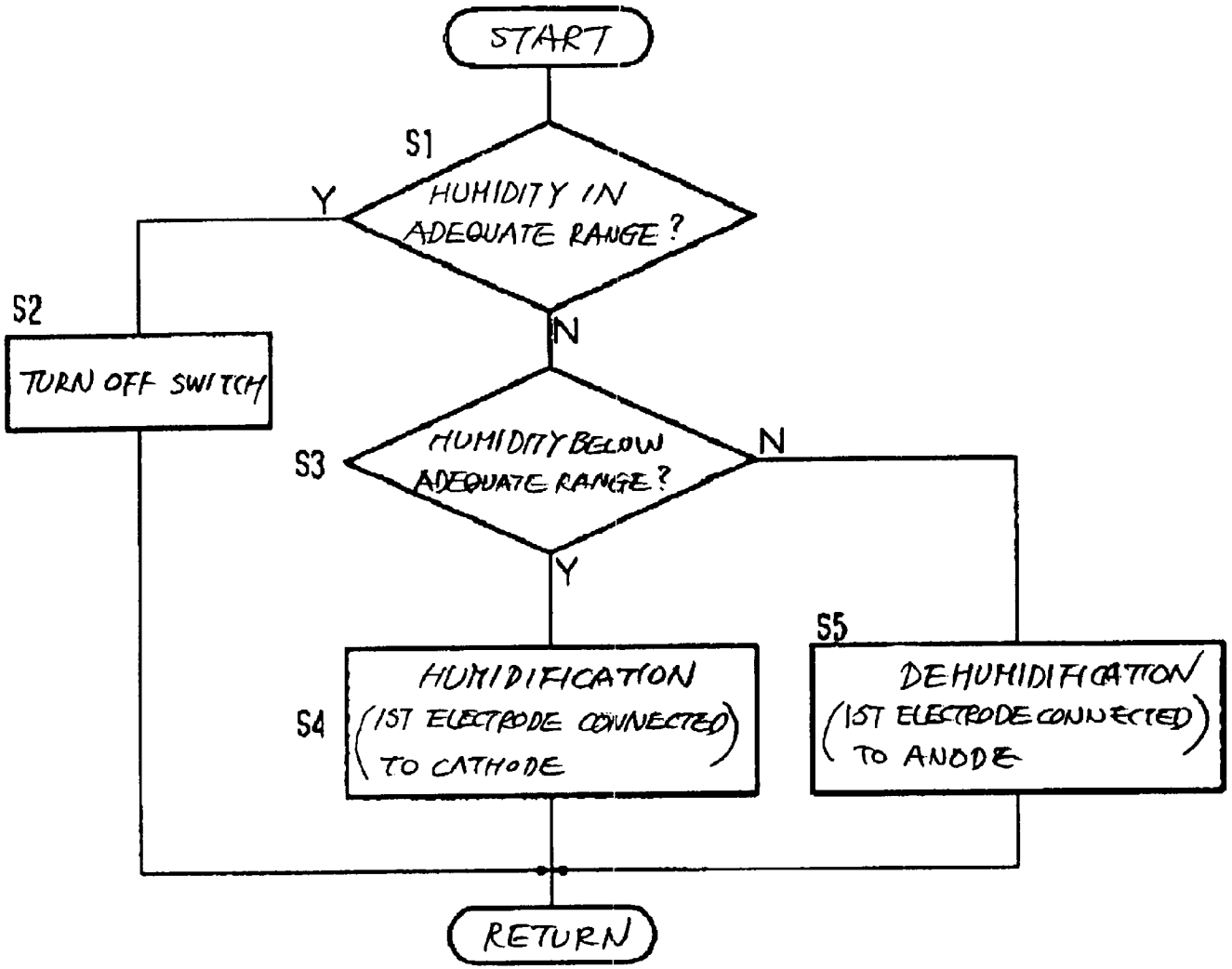
FIG. 17 is a flowchart demonstrating a specific operation of the thirteenth embodiment.

Reference will be made to FIG. 17 for describing a specific operation of the controller 43. As shown, on receiving the output of the humidity sensor 20, the controller 43 determines whether or not humidity in the casing member 16 lies in an adequate range (step S1). If the answer of the step S1 is positive, Y, then the controller 43 turns off the switch 41, i.e., does not effect humidification or dehumidification (step S2), thereby maintaining the current humidity.

If the answer of the step S1 is negative, N, then the controller 43 determines whether or not humidity in the casing member 16 is below the adequate range (step S3). If the answer of the step S3 is Y, then the controller 43 humidifies the inside of the casing member 16 (step S4). More specifically, the controller 43 connects the first and second electrodes 22 and 23 to the cathode and anode, respectively, of the power supply 42 by operating the switch 41, thereby applying a voltage between the first and the second electrodes 22 and 23. As a result, water is produced in the casing member 16 at the first electrode 22 side and humidifies the inside of the casing member 16 around the charge roller 27.

On the other hand, if the answer of the step S3 is N, meaning that humidity in the casing member 16 is above the adequate range, then the controller 43 dehumidifies the inside of the casing member 16 (step S5). More specifically, the controller 43 operates the switch 41 to connect the first and second electrodes 22 and 23 to the anode and cathode, respectively, of the power supply 42, thereby applying a voltage between the first and the second electrodes 22 and 23. As a result, water is decomposed in the casing member 16 at the first electrode 22 side and dehumidifies the inside of the casing member 16 around the charge roller 27.

As stated above, the humidity control mechanism 40 selectively effects humidification or dehumidification to thereby automatically maintain humidity around the charge roller 27 in the adequate range. It is therefore possible to insure high image quality by obviating irregular charging ascribable to excessively low humidity around the charge roller 27 and obviating blurring ascribable to excessively high humidity around the same.

Further, the humidity control mechanism 40, made up of the electrolytic film 21 and first and second porous electrodes 22 and 23, is mounted on part of the casing member and therefore does not need an exclusive space. This reduces the overall size of the printer despite the addition of the humidity control mechanism 40. In addition, the humidity control mechanism 40 does not need a tank for storing water for humidification or removed water and therefore makes it needless to replenish water to the tank, to sterilize the tank or to remove fur, thereby lowering running cost.

Fourteenth Embodiment

Figure 18:
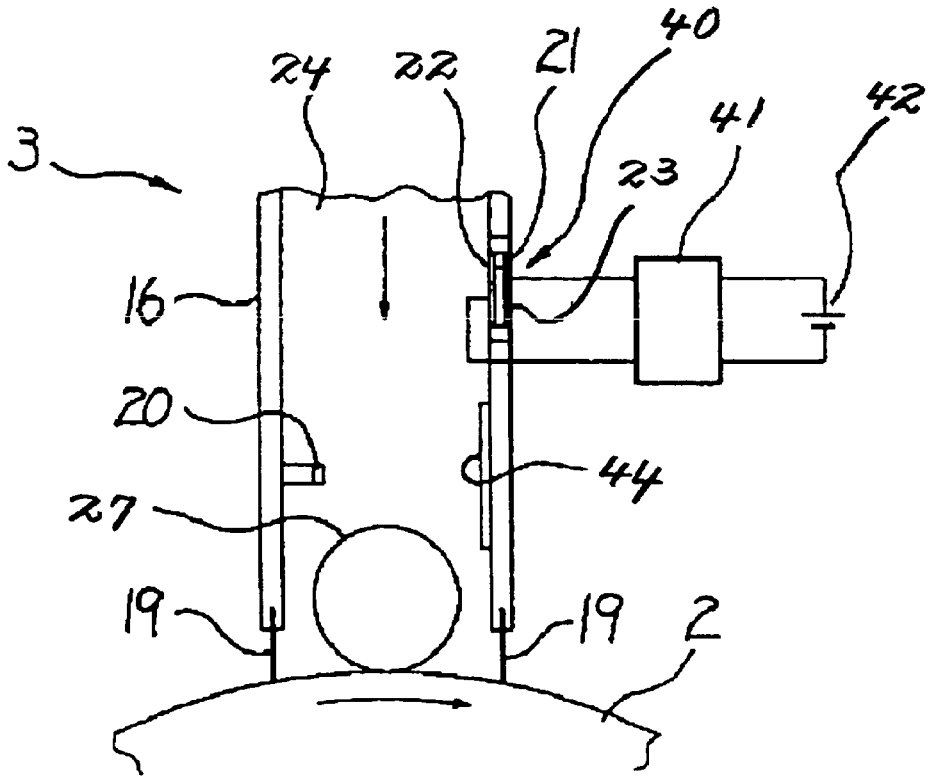
FIG. 18 is a view showing a charger representative of a fourteenth embodiment of the present invention.

A fourteenth embodiment of the present invention will be described with reference to FIG. 18. Structural parts and elements identical with those of FIGS. 14 through 17 are designated by identical reference numerals and will not be described specifically. This is also true with the other embodiments to follow.

As shown, the illustrative embodiment includes a sheet-like body 44 in which water-absorptive resin is dispersed, in addition to the configuration of the thirteenth embodiment. The body 44, having the function stated earlier, is mounted on the inner surface of the casing member 16 at a position downstream of the humidity control mechanism 40, but upstream of the charge roller 27, in the direction in which air flows through the air passage 24.

In operation, when the inside of the casing member 16 is humidified, the body 44 absorbs water produced in the casing member 16. When humidity in the casing member 16 starts decreasing after the control for humidification, the body 44 releases water to thereby prevent humidity in the casing member 16 from immediately decreasing to a degree that needs humidification. Therefore, humidity in the casing member 16 remains in the adequate range without humidification control being executed, reducing the duration of humidification control and therefore saving power.

Fifteenth Embodiment

Figure 19:
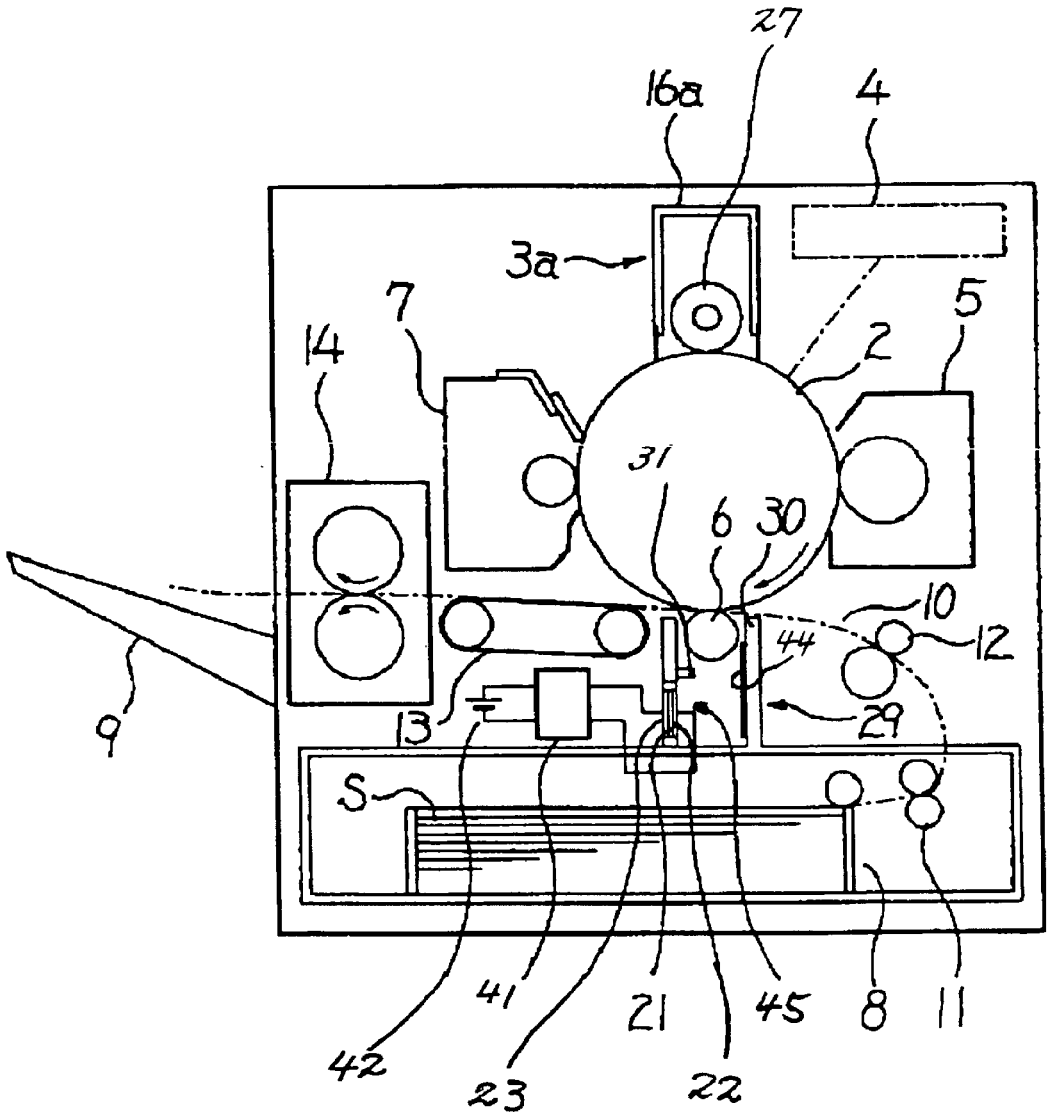
FIGS. 19 through 21 are views respectively a fifteenth to a seventeenth embodiment of the present invention.

FIG. 19 shows a fifteenth embodiment of the present invention. As shown, the charging device 3*a*, optical writing unit 4, developing device 5, image transferring device 29 and cleaning device 7 are arranged around the drum 2. The charging device 3*a* includes the charge roller 27 and casing member 16*a* surround it, but does not include the humidity control mechanism 40.

The image transferring device 29, facing the circumference of the drum 2, includes a humidity control mechanism 45 as well as the image transfer roller 6 and casing member 30 surrounding it. The humidity control mechanism 45 includes the solid, high-molecular electrolytic film 21 mounted on the casing member 30 with one surface facing the inside of the casing member 30 and the other surface facing the outside of the same. The first porous electrode 22 is mounted on the surface of the electrolytic film 21 facing the inside of the casing member 30 and is connected to one electrode of the power supply 42 via the switch 41. The second porous electrode 23 is mounted on the surface of the electrolytic film 21 facing the outside of the casing member 30 and is connected to the other electrode of the power supply 42 via the switch 41. Further, the body 44 and humidity sensor 31 are disposed in the casing member 30.

The various sections of the illustrative embodiment are also electrically connected as shown in FIG. 16, so that the inside of the casing member 30 is humidified or dehumidified in accordance with the output of the humidity sensor 31. It is therefore possible to insure high image quality by obviating irregular charging ascribable to excessively low humidity around the image transfer roller 6 and obviating the degradation of image transfer to the sheet S ascribable to excessively high humidity around the same.

Further, the humidity control mechanism 45, made up of the electrolytic film 21 and first and second porous electrodes 22 and 23, is mounted on part of the casing member 30 and therefore does not need an exclusive space. This reduces the overall size of the printer despite the addition of the humidity control mechanism 45. In addition, the humidity control mechanism 45 does not need a tank for storing water for humidification or removed water and therefore makes it needless to replenish water to the tank, to sterilize the tank or to remove fur, thereby lowering running cost.

When humidity in the casing member 30 starts decreasing after the control for humidification, the body 44 releases water to thereby prevent humidity in the casing member 30 from immediately decreasing to a degree that needs humidification. Therefore, humidity in the casing member 30 remains in the adequate range without humidification control being executed, reducing the duration of humidification control and therefore saving power.

Of course, the charging device 3*a*, lacking the humidity control mechanism 40, may be replaced with the charging device 3 including the humidity control mechanism 40.

Sixteenth Embodiment

Figure 20:
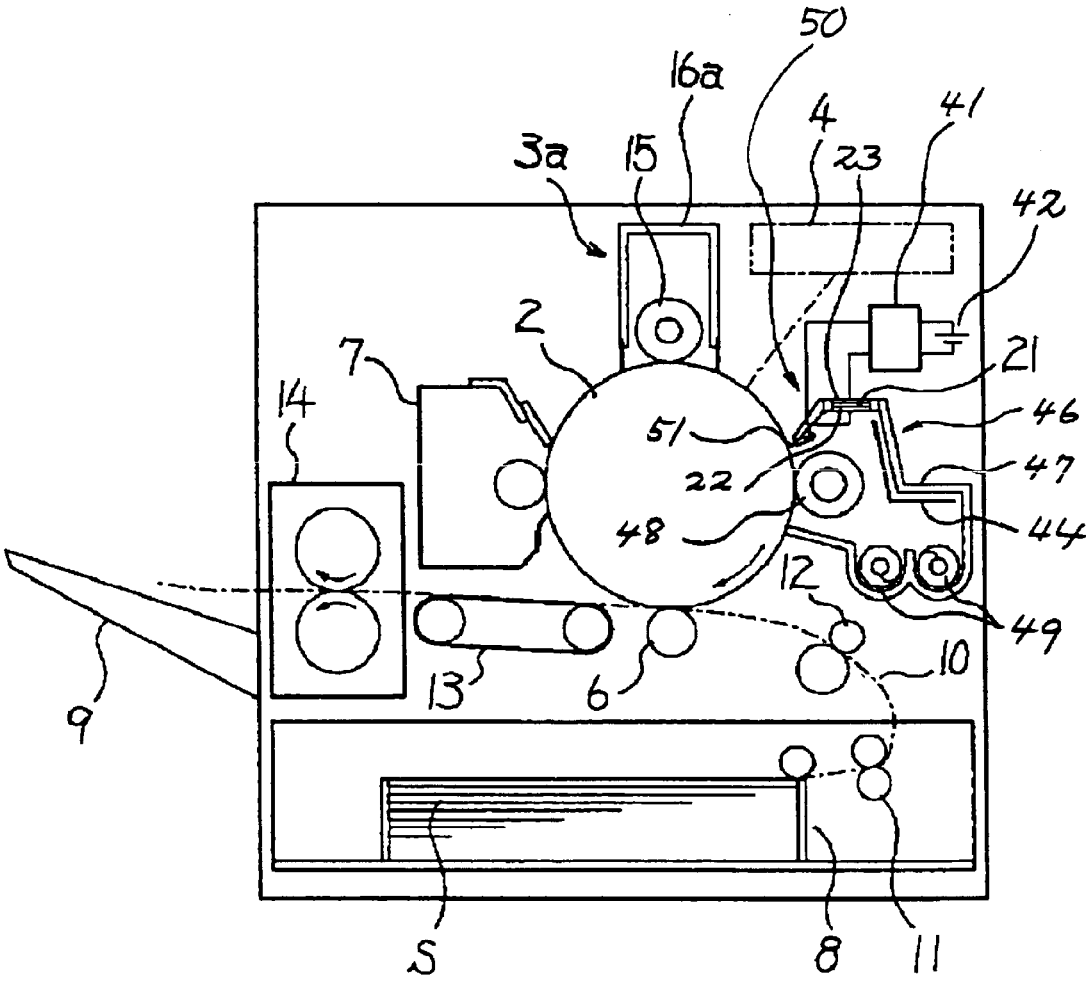

FIG. 20 shows a sixteenth embodiment of the present invention. As shown, a developing device 46 is arranged around the drum 2 together with the charging device 3*a*, optical writing unit 4, image transfer roller 6 and cleaning device 7.

The developing device 50 includes a toner case 47 storing toner, a developing roller 48 disposed in the toner case 47, a screw 49 for conveying the toner while agitating it, and a humidity control mechanism 50. The humidity control mechanism 50 includes the solid, high-molecular electrolytic film 21 mounted on the toner case 47 with one surface facing the inside of the toner case 47 and the other surface facing the outside of the same. The first porous electrode 22 is mounted on the surface of the electrolytic film 21 facing the inside of the toner case 47 and is connected to one electrode of the power supply 42 via the switch 41. The porous anode 23 is mounted on the surface of the electrolytic film 21 facing the outside of the toner case 47 and is connected to the other electrode of the power supply 42 via the switch 41. Further, the body 44 and humidity sensor 51 are disposed in the toner case 47.

With the above configuration, it is possible to confine humidity in the toner case 47 in the adequate range. If humidity in the toner case 47 is excessively low, then the charge of the toner excessively increases and makes it difficult for the toner to deposit on the drum 2 during development. Also, if the above humidity is excessively high, then the charge of the toner excessively decreases and causes the toner to deposit on the drum 2 in an excessive amount during development.

Further, the humidity control mechanism 50, made up of the electrolytic film 21 and first and second porous electrodes 22 and 23, is mounted on part of the toner case 47 and therefore does not need an exclusive space. This reduces the overall size of the printer despite the addition of the humidity control mechanism 50. In addition, the humidity control mechanism 50 does not need a tank for storing water for humidification or removed water and therefore makes it needless to replenish water to the tank, to sterilize the tank or to remove fur, thereby lowering running cost.

Because the humidity control mechanism 50 does not toner case 47, the toner does not fly about during humidification or dehumidification; otherwise, the toner would leak to the outside of the toner case 47.

Moreover, when humidity in the toner case 47 starts decreasing after the control for humidification, the body 44 releases water to thereby prevent humidity in the toner case 47 from immediately decreasing to a degree that needs humidification. Therefore, humidity in the toner case 47 remains in the adequate range without humidification control being executed, reducing the duration of humidification control and therefore saving power.

Of course, the charging device 3*a*, lacking the humidity control mechanism 40, may be replaced with the charging device 3 including the humidity control mechanism 40.

Seventeenth Embodiment

Figure 21:
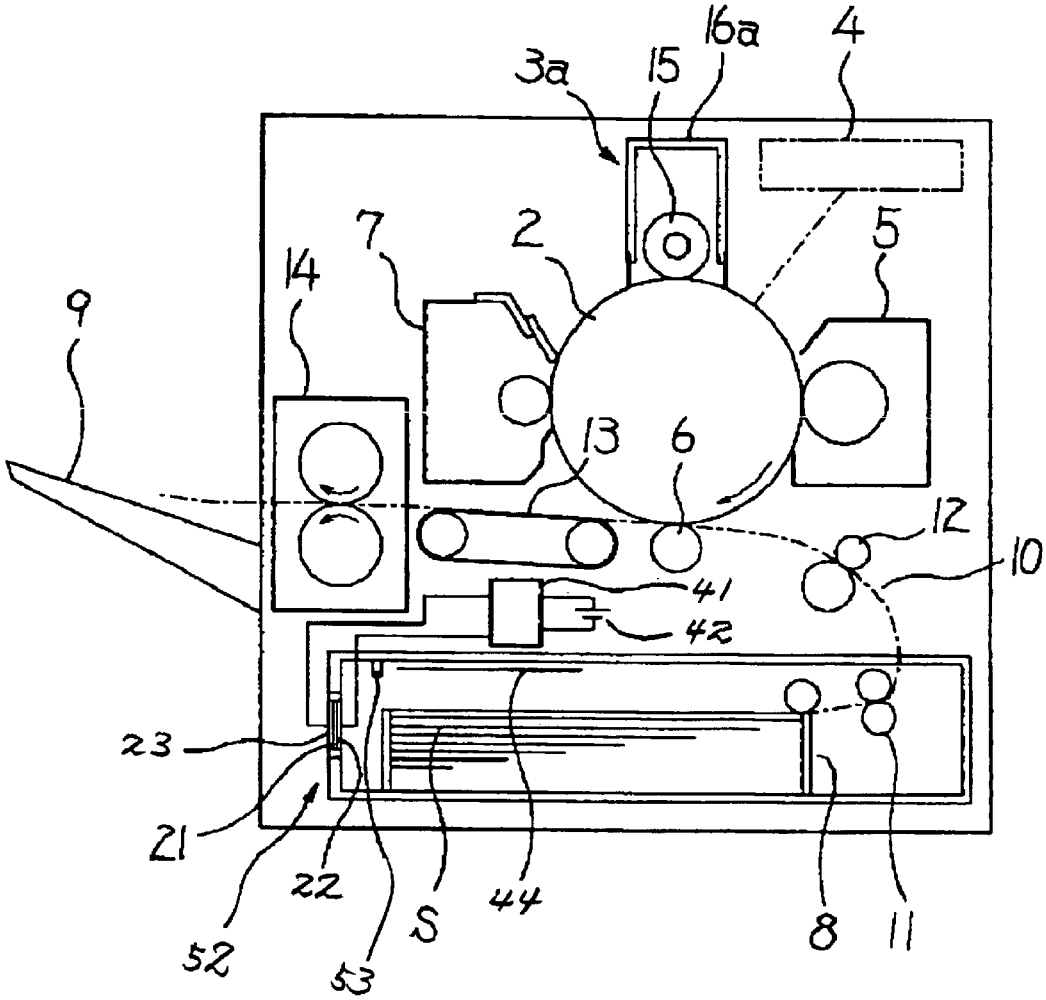

FIG. 21 shows a seventeenth embodiment of the present invention. As shown, the charging device 3*a*, optical writing unit 4, developing device 5, image transfer roller 6 and cleaning device 7 are arranged around the drum 2. The sheet feeding device or sheet storing section 8 is positioned below the above devices. A humidity control mechanism 52 is mounted on one side wall of the sheet feeding device 8.

The humidity control mechanism 52 includes the solid, high-molecular electrolytic film 21 mounted on the sheet feeding device 8 with one surface facing the inside of the device 8 and the other surface facing the outside of the same. The first porous electrode 22 is mounted on the surface of the electrolytic film 21 facing the inside of the sheet feeding device 8 and is connected to one electrode of the power supply 42 via the switch 41. The second porous electrode 23 is mounted on the surface of the electrolytic film 21 facing the outside of the sheet feeding device 8 and is connected to the other electrode of the power supply 42 via the switch 41.

Further, the body 44 and a humidity sensor 53 are disposed in the sheet feeding device 8.

The various sections of the illustrative embodiment are also electrically connected as shown in FIG. 16, so that the inside of the sheet feeding device 8 is humidified or dehumidified in accordance with the output of the humidity sensor 53. Therefore, humidity in the sheet feeding device 8 is confined in the adequate range under the control of the controller 43. If humidity in the sheet feeding device 8 is excessively low, then static electricity accumulates on the sheets S and causes two or more of them to be fed together. If the above humidity is excessively high, then the feed of the sheet S practically fails due to a decrease in the hardness of the sheet S. The humidity control mechanism 52 therefor insures smooth conveyance of the sheet S.

Further, the humidity control mechanism 52, made up of the electrolytic film 21 and first and second porous electrodes 22 and 23, is mounted on part of the sheet feeding device 8 and therefore does not need an exclusive space. This reduces the overall size of the printer despite the addition of the humidity control mechanism 52. In addition, the humidity control mechanism 50 does not need a tank for storing water for humidification or removed water and therefore makes it needless to replenish water to the tank, to sterilize the tank or to remove fur, thereby lowering running cost.

Moreover, when humidity in the sheet feeding device 8 starts decreasing after the control for humidification, the body 44 releases water to thereby prevent humidity in the sheet feeding device 8 from immediately decreasing to a degree that needs humidification. Therefore, humidity in the sheet feeding device 8 remains in the adequate range without humidification control being executed, reducing the duration of humidification control and therefore saving power.

Eighteenth Embodiment

Figure 22:
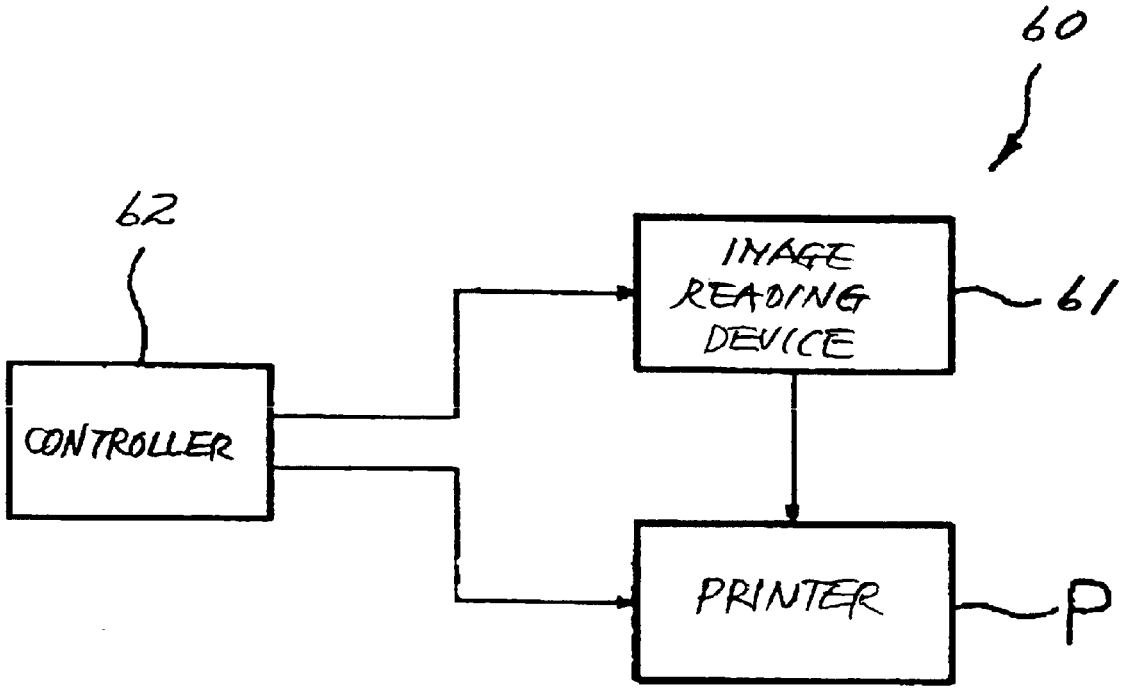
FIG. 22 is a schematic block diagram showing a copier representative of an eighteenth embodiment of the present invention.

FIG. 22 shows an eighteenth embodiment of the present invention implemented as a copier 60. As shown, the copier 60 is generally made up of a scanner or image reading device 61 for reading a document image, the printer P of any one of the previous embodiments, and a controller 62. The controller 62 causes the printer P to form an image on the sheet S in accordance with image data read by the scanner 61.

Various modifications will become possible for those skilled in the art after receiving the teachings of the present disclosure without departing from the scope thereof.

What is claimed is:

1. A charging device comprising:

a charging mechanism positioned to face a circumference of a photoconductive element;

a casing member surrounding said charging means;

a solid, high-molecular electrolytic film mounted on said casing member with one surface facing an inside of said casing member and the other surface facing an outside of said casing member;

a porous cathode mounted on a surface of said electrolytic film, which faces the inside of said casing member, and connected to a cathode of a power supply; and a porous anode mounted on a surface of said electrolytic film, which faces the outside of said casing member, and connected to an anode of the power supply.

2. The device as claimed in claim 1, wherein said porous anode faces the circumference of the photoconductive element.

3. The device as claimed in claim 2, wherein said electrolytic film, said porous cathode and said porous anode are positioned at each of a position upstream of said charging mechanism in a direction of rotation of the photoconductive element and a position downstream of said charging mechanism in said direction.

4. The device as claimed in claim 1, further comprising a dehumidifying air passage formed outside of said casing member and configured to send air from a region facing said porous anode toward the circumference of the photoconductive element.

5. The device as claimed in claim 4, wherein said electrolytic film, said porous cathode and said porous anode are positioned at each of a position upstream of said charging mechanism in a direction of rotation of the photoconductive element and a position downstream of said charging mechanism in said direction.

6. The device as claimed in claim 1, further comprising a humidifying air passage formed inside of said casing member and configured to send air from a region facing said porous cathode toward said charging mechanism.

7. The device as claimed in claim 1, further comprising a body disposed in said casing member and containing water-absorptive resin dispersed therein.

8. The device as claimed in claim 1, wherein said charging mechanism comprises contact type charging mechanism.

9. An image transferring device comprising:

an image transferring mechanism positioned to face a circumference of a photoconductive element;

a casing member surrounding said image transferring mechanism;

a solid, high-molecular electrolytic film mounted on said casing member with one surface facing an inside of said casing member and the other surface facing an outside of said casing member;

a porous cathode mounted on a surface of said electrolytic film, which faces the inside of said casing member, and connected to a cathode of a power supply; and a porous anode mounted on a surface of said electrolytic film, which faces the outside of said casing member, and connected to an anode of the power supply.

10. The device as claimed in claim 9, wherein said porous anode faces a recording medium feeding device storing recording media.

11. The device as claimed in claim 9, further comprising a body disposed in said casing member and containing water-absorptive resin dispersed therein.

12. A developing device comprising:

a toner case configured to store a toner;

a solid, high-molecular electrolytic film mounted on said toner case with one surface facing an inside of said toner case and the other surface facing an outside of said toner case;

a porous cathode mounted on a surface of said electrolytic film, which faces the inside of said toner case, and connected to a cathode of a power supply; and a porous anode mounted on a surface of said electrolytic film, which faces the outside of said toner case, and connected to an anode of the power supply.

13. The device as claimed in claim 12, further comprising a dehumidifying air passage formed outside of said toner case and configured to send air from a region facing said porous anode toward a circumference of a photoconductive element.

14. The device as claimed in claim 12, further comprising a body disposed in said toner case and containing water-absorptive resin dispersed therein.

15. A sheet discharging device comprising:

a print tray to which a recording medium passed through a fixing device is discharged;

a casing member surrounding at least either one of an upper surface and a lower surface of the recording medium discharged to said print tray;

a solid, high-molecular electrolytic film mounted on said casing member with one surface facing an inside of said casing member and the other surface facing an outside of said casing member;

a porous cathode mounted on a surface of said electrolytic film, which faces the inside of said casing member, and connected to a cathode of a power supply; and a porous anode mounted on a surface of said electrolytic film, which faces the outside of said easing member, and connected to an anode of the power supply.

16. The device as claimed in claim 15, wherein said porous anode faces a recording medium feeding device storing recording media.

17. The device as claimed in claim 15, wherein said porous anode faces a fixing device.

18. In an image forming apparatus for exposing a circumference of a photo conductive element, which is charged by a charging device, to thereby form a latent image, causing a developing device to develop said latent image with a toner to thereby produce a corresponding toner image, causing an image transferring device to transfer said toner image to a recording medium, causing a fixing device to fix said toner image on said recording medium, and discharging said recording medium with said toner image fixed to a sheet discharging device, said charging device comprising:

a charging mechanism positioned to face a circumference of the photoconductive element;

a casing member surrounding said charging mechanism;

a solid, high-molecular electrolytic film mounted on said casing member with one surface facing an inside of said casing member and the other surface facing an outside of said casing member;

a porous cathode mounted on a surface of said electrolytic film, which faces the inside of said casing member, and connected to a cathode of a power supply; and a porous anode mounted on a surface of said electrolytic film, which faces the outside of said casing member, and connected to an anode of the power supply.

19. The apparatus as claimed in claim 18, wherein said porous anode faces the circumference of said photoconductive element.

20. The apparatus as claimed in claim 19, wherein said electrolytic film, said porous cathode and said porous anode are positioned at each of a position upstream of said charging mechanism in a direction of rotation of the photoconductive element and a position downstream of said charging mechanism in said direction.

21. The apparatus as claimed in claim 18, further comprising a dehumidifying air passage formed outside of said casing member and configured to send air from a region facing said porous anode toward the circumference of the photoconductive element.

22. The apparatus as claimed in claim 21, wherein said electrolytic film, said porous cathode and said porous anode are positioned at each of a position upstream of said charging mechanism in a direction of rotation of said photoconductive element and a position downstream of said charging mechanism in said direction.

23. The apparatus as claimed in claim 18, further comprising a humidifying air passage formed inside of said casing member and configured to send air from a region facing said porous cathode toward said charging means.

24. The apparatus as claimed in claim 18, further comprising a body disposed in said casing member and containing water-absorptive resin dispersed therein.

25. The apparatus as claimed in claim 18, wherein said charging mechanism comprises a contact type charging mechanism.

26. In an image forming apparatus for exposing a circumference of a photoconductive element, which is charged by a charging device, to thereby form a latent image, causing a developing device to develop said latent image with a toner to thereby produce a corresponding toner image, causing an image transferring device to transfer said toner image to a recording medium, causing a fixing device to fix said toner image on said recording medium, and discharging said recording medium with said toner image fixed to a sheet discharging device, said image transferring device comprising:

an image transferring mechanism positioned to face the circumference of the photoconductive element;

a casing member surrounding said image transferring mechanism;

a solid, high-molecular electrolytic film mounted on said casing member with one surface facing an inside of said casing member and the other surface facing an outside of said casing member;

a porous cathode mounted on a surface of said electrolytic film, which faces the inside of said casing member, and connected to a cathode of a power supply; and a porous anode mounted on a surface of said electrolytic film, which faces the outside of said casing member, and connected to an anode of the power supply.

27. The apparatus as claimed in claim 26, wherein said porous anode faces a recording medium feeding device storing recording media.

28. The apparatus as claimed in claim 26, further comprising a body disposed in said casing member and containing water-absorptive resin dispersed therein.

29. In an image forming apparatus for exposing a circumference of a photoconductive element, which is charged by a charging device, to thereby form a latent image, causing a developing device to develop said latent image with a toner to thereby produce a corresponding toner image, causing an image transferring device to transfer said toner image to a recording medium, causing a fixing device to fix said toner image on said recording medium, and discharging said recording medium with said toner image fixed to a sheet discharging device, said developing device comprising:

a toner case configured to store the toner;

a solid, high-molecular electrolytic film mounted on said toner case with one surface facing an inside of said toner case and the other surface facing an outside of said toner case;

a porous cathode mounted on a surface of said electrolytic film, which faces the inside of said toner case, and connected to a cathode of a power supply; and a porous anode mounted on a surface of said electrolytic film, which faces the outside of said toner case, and connected to an anode of the power supply.

30. The apparatus as claimed in claim 29, further comprising a dehumidifying air passage formed outside of said toner case and configured to send air from a region facing said porous anode toward a circumference of the photoconductive element.

31. The apparatus as claimed in claim 29, further comprising a body disposed in said toner case and containing water-absorptive resin dispersed therein.

32. In an image forming apparatus for exposing a circumference of a photoconductive element, which is charged by a charging device, to thereby form a latent image, causing a developing device to develop said latent image with a toner to thereby produce a corresponding toner image, causing an image transferring device to transfer said toner image to a recording medium, causing a fixing device to fix said toner image on said recording medium, and discharging said recording medium with said toner image fixed to a sheet discharging device, said sheet discharging device comprising:

a print tray to which the recording medium passed through the fixing device is discharged;

a casing member surrounding at least either one of an upper surface and a lower surface of the recording medium discharged to said print tray;

a solid, high-molecular electrolytic film mounted on said casing member with one surface facing an inside of said casing member and the other surface facing an outside of said casing member;

a porous cathode mounted on a surface of said electrolytic film, which faces the inside of said casing member, and connected to a cathode of a power supply; and a porous anode mounted on a surface of said electrolytic film, which faces the outside of said casing member, and connected to an anode of the power supply.

33. The apparatus as claimed in claim 32, wherein said porous anode faces a recording medium feeding device storing recording media.

34. The apparatus as claimed in claim 32, wherein said porous anode faces the fixing device.

35. An electrophotographic image forming apparatus for forming a latent image on an image carrier by exposing said image carrier, developing said latent image with a toner to thereby produce a corresponding toner image, and transferring said toner image to a recording medium, said image forming apparatus comprising:

a charging mechanism positioned to face a circumference of the image carrier;

a casing member surrounding said charging mechanism;

a solid, high-molecular electrolytic film mounted on said casing member with one surface facing an inside of said casing member and the other surface facing an outside of said casing member;

a porous first electrode mounted on a surface of said electrolytic film, which faces the inside of said casing member, and connected to one electrode of a power supply;

a porous second electrode mounted on a surface of said electrolytic film, which faces the outside of said casing member, and connected to the other electrode of the power supply;

a humidity sensor responsive to humidity in said casing member;

a control mechanism configured to selectively apply a voltage to said first porous electrode and said second porous electrode and switching a polarity of said voltage in accordance with an output of said humidity sensor; and an image forming mechanism configured to transfer said toner image to the recording medium.

36. The apparatus as claimed in claim 35, further comprising an air passage formed in said casing member and configured to send air from a region facing said first porous electrode toward said charging means.

37. The apparatus as claimed in claim 35, wherein said charging mechanism comprises a contact type charging mechanism.

38. The apparatus as claimed in claim 35, further comprising a body disposed in said casing member and containing water-absorptive resin dispersed therein.

39. An electrophotographic image forming apparatus for forming a latent image on an image carrier by exposing said image carrier, developing said latent image with a toner to thereby produce a corresponding toner image, and transferring said toner image to a recording medium, said image forming apparatus comprising:

an image transferring mechanism positioned to face a circumference of the image carrier;

a casing member surrounding said image transferring mechanism;

a solid, high-molecular electrolytic film mounted on said casing member with one surface facing an inside of said casing member and the other surface facing an outside of said casing member;

a porous first electrode mounted on a surface of said electrolytic film, which faces the inside of said casing member, and connected to one electrode of a power supply;

a porous second electrode mounted on a surface of said electrolytic film, which faces the outside of said casing member, and connected to the other electrode of the power supply;

a humidity sensor responsive to humidity in said casing member;

a control mechanism configured to selectively apply a voltage to said first porous electrode and said second porous electrode and switching a polarity of said voltage in accordance with an output of said humidity sensor; and an image forming mechanism configured to transfer said toner image to the recording medium.

40. The apparatus as claimed in claim 39, further comprising a body disposed in said casing member and containing water-absorptive resin dispersed therein.

41. An electrophotographic image forming apparatus for forming a latent image on an image carrier by exposing said image carrier, developing said latent image with a toner to thereby produce a corresponding toner image, and transferring said toner image to a recording medium, said image forming apparatus comprising:

a toner case configured to store the toner;

a solid, high-molecular electrolytic film mounted on said toner case with one surface facing an inside of said toner case and the other surface facing an outside of said toner case;

a porous first electrode mounted on a surface of said electrolytic film, which faces the inside of said toner case, and connected to one electrode of a power supply;

a porous second electrode mounted on a surface of said electrolytic film, which faces the outside of said toner case, and connected to the other electrode of the power supply;

a humidity sensor responsive to humidity in said toner case;

a control mechanism configured to selectively apply a voltage to said first porous electrode and said second porous electrode and switching a polarity of said voltage in accordance with an output of said humidity sensor; and an image forming mechanism configured to transfer said toner image to the recording medium.

42. The apparatus as claimed in claim 41, further comprising a body disposed in said toner case and containing water-absorptive resin dispersed therein.

43. An electrophotographic image forming apparatus for forming a latent image on an image carrier by exposing said image carrier, developing said latent image with a toner to thereby produce a corresponding toner image, and transferring said toner image to a recording medium, said image forming apparatus comprising:

a storing section configured to store the recording medium;

a solid, high-molecular electrolytic film mounted on a wall of said storing section with one surface facing an inside of said storing section case and the other surface facing an outside of said storing section case;

a porous first electrode mounted on a surface of said electrolytic film, which faces the inside of said storing section case, and connected to one electrode of a power supply;

a porous second electrode mounted on a surface of said electrolytic film, which faces the outside of said storing section, and connected to the other electrode of the power supply;

a humidity sensor responsive to humidity in said storing section;

a control mechanism configured to selectively applying a voltage to said first porous electrode and said second porous electrode and switching a polarity of said voltage in accordance with an output of said humidity sensor; and an image forming mechanism configured to transfer said toner to the recording medium.

44. The apparatus as claimed in claim 43, further comprising a body disposed in said storing section and containing water-absorptive resin dispersed therein.

* * * * *